US006260532B1

(12) United States Patent
Mendler

(10) Patent No.: US 6,260,532 B1
(45) Date of Patent: Jul. 17, 2001

(54) RIGID CRANKSHAFT CRADLE AND ACTUATOR

(76) Inventor: Edward Charles Mendler, 3522 Northampton St., NW., Washington, DC (US) 20015

( * ) Notice: Subject to any disclaimer, the term of this patent is extended or adjusted under 35 U.S.C. 154(b) by 0 days.

(21) Appl. No.: 09/406,124

(22) Filed: Sep. 27, 1999

Related U.S. Application Data

(60) Provisional application No. 60/101,999, filed on Sep. 28, 1998.

(51) Int. Cl.[7] ..... F02B 75/04
(52) U.S. Cl. ..... 123/192.2
(58) Field of Search ..... 123/192.2, 48 B, 123/78 F, 90.31, 90.27, 90.15

(56) References Cited

U.S. PATENT DOCUMENTS

| | | |
|---|---|---|
| 741,179 | 10/1903 | Sproehnle . |
| 887,633 | 5/1908 | Heginbottom . |
| 936,409 | 10/1909 | Chapman . |

(List continued on next page.)

FOREIGN PATENT DOCUMENTS

| | | |
|---|---|---|
| 3127760 | 3/1983 | (DE) . |
| 3644721 A1 | 7/1988 | (DE) . |
| 0 345 366 A1 | 12/1989 | (EP) . |
| 0 426 540 A1 | 10/1990 | (EP) . |

(List continued on next page.)

OTHER PUBLICATIONS

Doglas et la., An Experimental Single Cylinder Ecclink VCR Engline, SAE paper No. 921695, pub. 1992.

Larson, "Research Engine for Evaluating the Effects of Variable Compression Ratio . . ." SAE paper No. 910053, pub. 1991.

Wirbeleit et al., "Development of Pistons with Variable Compression Height . . ." SAE paper No. 900229, pub. 1990.

Wallace et al., "A Variable Compression Ratio Engine Development" SAE paper No. 762A, pub. Oct. 1963.

*Primary Examiner*—Noah P. Kamen
*Assistant Examiner*—Hyder Ali

(57) ABSTRACT

Poor full power engine performance in variable compression ratio engines resulting from small valve overlap periods, necessary for preventing piston-to-valve strike at high compression ratio, is prevented by phase shifting of the intake and exhaust valves with change of compression ratio. The crankshaft is rotatably mounted in eccentric main bearing supports for adjusting the position of the crankshaft rotational axis relative to the engine housing. A drive gear is mounted on the crankshaft and a first driven gear is mounted on a secondary shaft mounted in the engine housing. The secondary shaft drives the intake camshaft drive. The mesh direction between the drive gear and the first driven gear points generally away from the cylinder head of the engine. A second driven gear is mounted on a third shaft, the second driven gear being in mesh with a drive gear mounted on the crankshaft. The third shaft drives the exhaust camshaft drive. The crankshaft axis of rotation is located between the gear mesh of the second driven gear and the gear mesh of the third driven gear. At high compression ratio, valve overlap duration is short, providing good engine idling stability and preventing piston to valve strike. Rotating the eccentric main bearing supports and moving the crankshaft rotational axis away from the cylinder head of the engine lowers the compression ratio of the engine and adjusts the phase timing of the second and third driven gears relative to the crankshaft, increasing the valve overlap period of the intake and exhaust valves and providing significantly increased maximum engine power. The pitch diameter of the first and second driven gears is set to provide an optimum range of valve overlaps.

12 Claims, 17 Drawing Sheets

U.S. PATENT DOCUMENTS

| | | | | |
|---|---|---|---|---|
| 1,160,940 | | 11/1915 | Momo . | |
| 1,715,368 | | 6/1929 | Jaussaud . | |
| 1,872,856 | | 8/1932 | Walker . | |
| 2,357,031 | | 8/1944 | Stabler . | |
| 2,433,639 | | 12/1947 | Woodruff et al. . | |
| 2,589,958 | | 3/1952 | Petit . | |
| 2,770,224 | | 11/1956 | Ericson . | |
| 3,633,552 | | 1/1972 | Huber . | |
| 4,195,613 | | 4/1980 | Bratt et al. . | |
| 4,738,230 | | 4/1988 | Johnson . | |
| 4,776,307 | * | 10/1988 | Ruf et al. | 123/90.31 |
| 4,860,702 | | 8/1989 | Doundoulakis . | |
| 5,038,731 | * | 8/1991 | Shimada | 123/192.2 |
| 5,215,051 | | 6/1993 | Smith . | |
| 5,218,885 | * | 6/1993 | Nakano et al. | 123/192.2 |
| 5,572,959 | | 11/1996 | Hedelin . | |
| 5,605,120 | | 2/1997 | Hedelin . | |
| 5,611,301 | | 3/1997 | Gillbrand et al. . | |

FOREIGN PATENT DOCUMENTS

| | | |
|---|---|---|
| 0 560 701 A1 | 2/1993 | (EP) . |
| 440 863 | 3/1912 | (FR) . |
| 20326 | 9/1906 | (GB) . |
| 13152 | 6/1907 | (GB) . |
| 55 64131 | 5/1980 | (JP) . |
| WO 92/09799 | 6/1992 | (WO) . |
| WO 97/36096 | 10/1997 | (WO) . |

* cited by examiner

FIG. 1
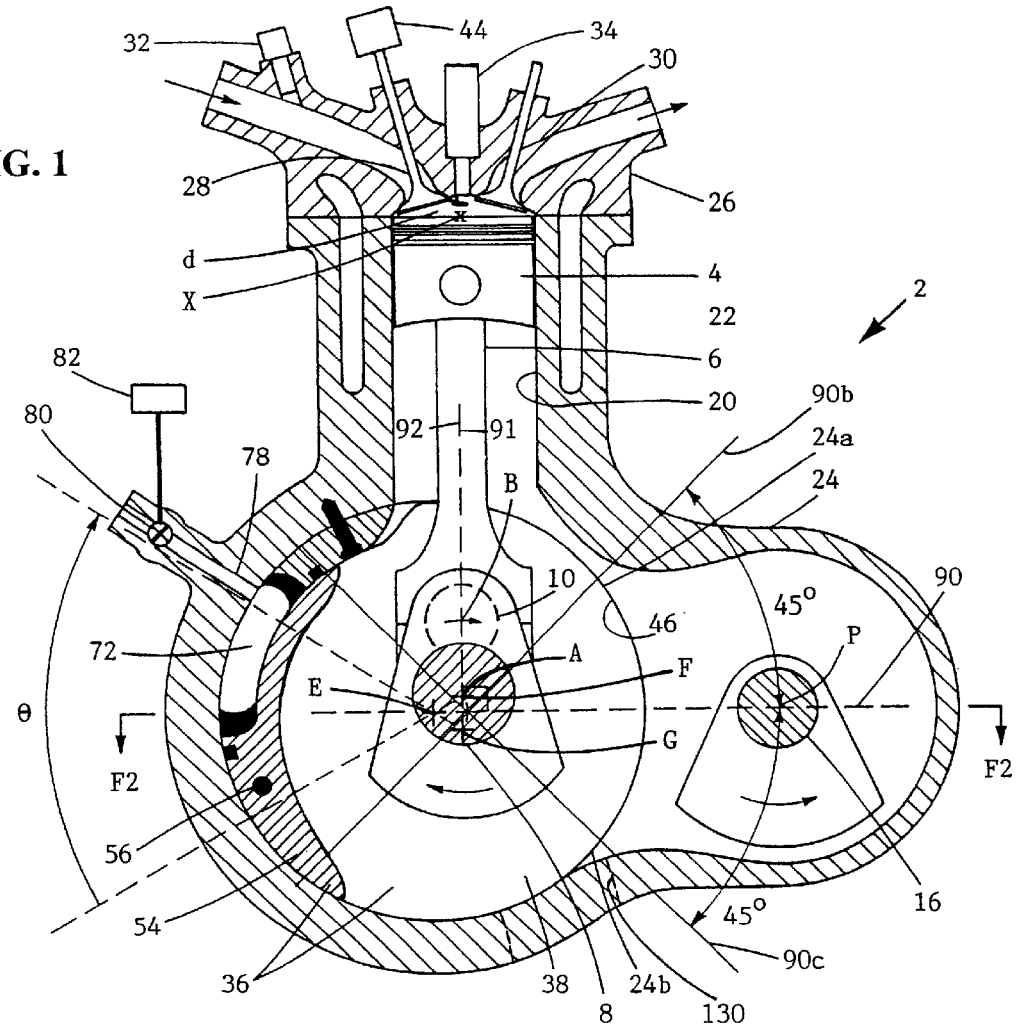
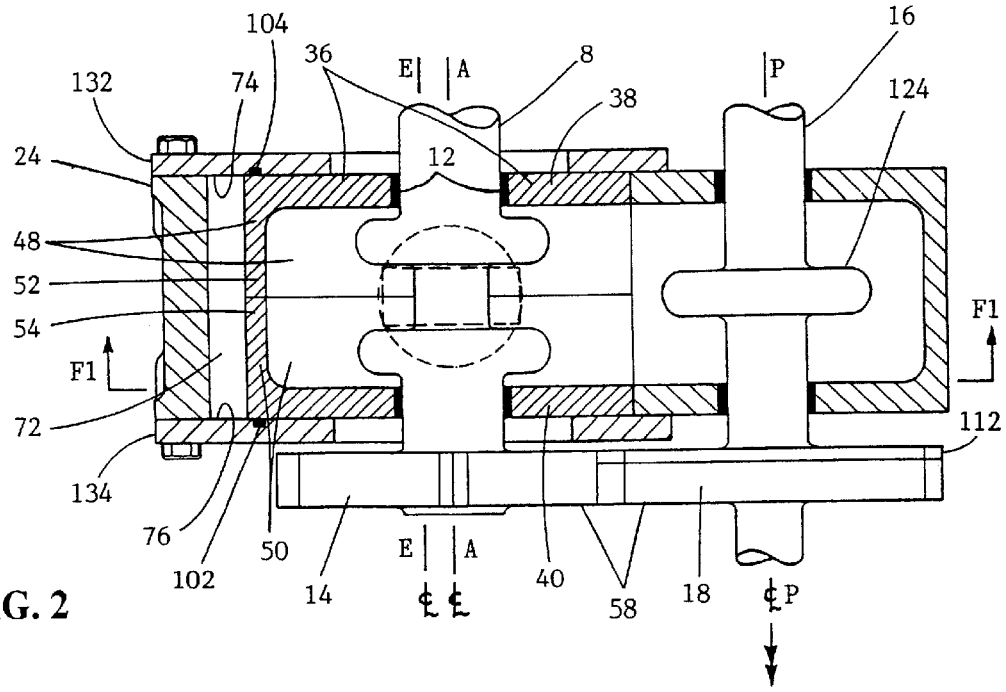
FIG. 2

RIGID CRANKSHAFT CRADLE AND ACTUATOR

PROVISIONAL APPLICATION REFERENCE

This application relates to Provisional Application No. 60/101,999, having a filing date of Sep. 28, 1998

BACKGROUND OF THE INVENTION

The present invention relates to a method and apparatus for adjusting the compression ratio of internal combustion engines, and more specifically to a method and apparatus for adjusting the position of the crankshaft with eccentric crankshaft main bearing supports.

Designs for engines having eccentric crankshaft main bearing supports have been known for some time. In these engines the eccentric main bearings are rotated to adjust the position of the crankshaft's axis of rotation. Poor rotational alignment of the eccentric main bearing supports is a problem for these engines because even small amounts of main bearing misalignment can cause rapid main bearing failure.

Significant forces bear down on the eccentric main bearing supports during operation of the engine. In modem passenger car engines main bearing loads can exceed 50 MPa. The forces exerted on the eccentric main bearing supports are, at times, significantly different from one eccentric main bearing support to the next. For example, in multi-cylinder engines a clockwise torque may be applied on a first eccentric main bearing support from the combustion pressure bearing down on the first piston, connecting rod and crank throw, and a counterclockwise torque may be applied on a second or third eccentric main bearing support from the inertial forces of the second piston and connecting rod pulling up on the second crank throw. As a second example, in a single cylinder engine having two eccentric main bearing supports the torque applied to the crank throw and the resistive torque at the power take-off end of the crankshaft cause uneven loading on the eccentric main bearing supports. These large unequal forces are a problem because they cause the eccentric sections to rotate out of alignment with one another causing rapid failure of the crankshaft main bearings.

In U.S. Pat. No. 887,633, and in German patent DE 3644721 A1 a pinned linkage is show for adjusting the rotational alignment of the eccentric main bearing sections. U.S. Pat. No. 4,738,230 shows dowels extending from each eccentric main bearing support that are fitted into slots located in a slidable bar for adjusting the rotational alignment of the eccentric main bearing supports. U.S. Pat. Nos. 5,572,959 and 5,605,120 show gear teeth extending from eccentric main bearing supports that engage a layshaft with mating gears for adjusting the rotational alignment of the eccentric main bearing supports. U.S. Pat. No. 1,160,940 shows a bail shaped frame that connects adjacent eccentric sections for adjusting the rotational alignment of the eccentric sections. Poor alignment of the main bearings is a significant problem for each of these systems. In addition to poor main bearing alignment, a number of these systems are not mechanically functional for other reasons, are impractical for mass production manufacture and assembly, and/or are not functional for engines having more than two main bearings. For example, U.S. Pat. No. 1,160,940 shows a bail shaped frame that is weakly connected to the eccentrics and that does not have a rigid construction. In addition to not rigidly hold the bearings in alignment, the system is not mechanically functional because the connecting rod does not clear the bail shaped frame. The system is also not functional for engines having more than two main bearings because it is not possible to slide the eccentric main bearing support onto the center crankshaft journal or journals.

A further problem with engines having rotatable eccentric main bearing supports in a fixed engine housing is that the location of the crankshaft rotational axis changes with change of compression ratio, making use of a conventional in-line clutch impossible. Geared power take-off couplings for engines having an adjustable crankshaft rotational axis are shown in the prior art, however a problem with these systems is that heavy structural reinforcing is required to rigidly hold the gear set in alignment. In addition to the problem of added weight, engine housing length is also increased.

German patent DE 3644721 A1 shows a gear set mounted to the free end of one of the eccentric crankshaft main bearing supports. The gear set has an intermediary shaft and an output shaft. The output shaft points generally away from the crankshaft, and has a fixed axis of rotation for all compression ration settings. A problem with the system shown in German patent DE 3644721 A1 is that during periods of high engine torque the end eccentric main bearing support may bend out of alignment, resulting in damage to the crankshaft main bearing. The gear set is also bulky and increases cranktrain friction losses due to the increased number of bearings and gear friction. U.S. Pat. No. 4,738,230 shows a first spur gear mounted on the crankshaft and a second spur gear having an axis of rotation that is concentric with the axis of rotation of the main bearing supports. These gears are too small to carry the torsional loads of the engine. U.S. Pat. No. 4,738,230 also shows a power take-off system having an internal or annular gear set. Heavy and lengthy structural reinforcing is required for holding the ring gear shaft in rigid alignment with the gear mounted on the end of the crankshaft. U.S. Pat. Nos. 5,443,043, 5,572,959 and 5,605,120 show a crankshaft having a fixed axis of rotation and an upper engine that changes position relative to its supporting frame when the compression ratio is changed. While a conventional in-line clutch can be employed with this arrangement, the position of the upper engine is changed when the compression ratio is changed, and the inertial mass of the upper engine prevents rapid adjustment of compression ratio.

A further problem with variable compression ratio engines is that the exhaust valves must be closed early and the intake valves opened late in order to prevent valve to piston strike near top dead center (TDC) of the piston. The short valve overlap period where both valves are open is a problem, because air flow into the engine is restricted causing a loss of engine power. Valve pockets can be formed in the piston to increase valve to piston clearance, however, the pockets add volume to the combustion chamber causing the compression ratio of the engine to be reduced. The base height of the piston can be raised further to compensate for the increase of chamber volume, however increasing the piston height increases the depth of the valve pockets. A significant problem is that the relatively large valve pockets cause increased heat loss from the combustion chamber due to the increased chamber surface area and due to the jagged chamber surface shape. The increased heat loss adversely effects engine fuel economy and power. Camshaft phase shifters such as those used on the Lexus LS 400, and/or cam profile switching devices such as those used on Honda VTech engines can be employed to prevent piston to valve strike, however, in addition to being expensive, these devices may fail to react fast enough in some vehicles that have been aged. Compression ratio may be changed in less than one second, and possibly within a tenth of a second. Failure of the variable valve device to respond at least as quickly as the variable compression ratio devise could result in valve to piston strike, causing major engine failure resulting in a significant warranty cost.

A problem with variable compression ratio mechanisms is that the actuator consumes a significant amount of energy, off-setting the fuel economy benefit of the variable compression ratio. U.S. Pat. No. 5,611,301 issued to Per Gillbrand and Lars Bergsten of Saab Automobile Akliebolag, for example, shows a variable compression ratio mechanism where the entire upper engine moves. A significant amount of power would be consumed to rapidly move the engine and change the compression ratio, off-setting the fuel economy benefit of the variable compression ratio. A central problem with variable compression ratio mechanisms is the power consumed in the process of adjusting the compression ratio.

Primary engine balancing can be accomplished with twin counter rotating balance shafts. A problem with balance shafts, however, is that of added bearing friction and windage, which adversely effects engine efficiency and vehicle fuel economy. Single balance shaft are employed in many single-cylinder motorcycles such as the Honda XR650L, the Kawasaki KLX250R, and the BMW F650. In these engines half of the balance mass on the balance shaft and half of the balance mass is placed on the crank web, however, vibration remains significant due to the moment remaining between the crankshaft and single balance shaft axes of rotation.

SUMMARY OF THE INVENTION

In the present invention, a rotatable rigid crankshaft cradle is employed for holding the crankshaft main bearings in alignment. The crankshaft cradle is rotatably mounted in the engine on a pivot axis, and the crankshaft is mounted in the crankshaft cradle on a second axis off-set from the pivot axis. An actuator rotates the crankshaft cradle and adjusts the position of the crankshaft axis of rotation and the compression ratio of the engine. The crankshaft cradle rigidly holds the main bearings in precise alignment at all times and provides long bearing life. The crankshaft cradle provides rigid support of crankshafts for single and multi-cylinder engines, ranging from crankshafts having two main bearings for single and two cylinder engines, to crankshafts having five or more main bearings for in-line-four cylinder engines, V8 engines, as well as other engines. In addition to providing a long main bearing life, the variable compression ratio mechanism of the present invention is reliable and has a low cost.

Referring now to FIGS. 3, 4 and 5, in an embodiment of the present invention a crankshaft cradle 60 is rotatably mounted in the engine housing on a pivot axis E, and a crankshaft 61 is mounted in the crankshaft cradle on a second axis A off-set from the pivot axis. The cradle includes two or more main bearing supports or eccentric members 62 and structural webbing 64 for rigidly holding the eccentric members and main bearings in alignment. One or more bearing caps 68 are fastened to the cradle with bolts or another type of fastener for securing the crankshaft in the cradle. The bearing caps are removable from the cradle permitting assembly of the crankshaft in the cradle. Operation of the main bearings without failure requires precise alignment of the main bearing supports at all times. According to the present invention, adjacent main bearing supports are held in rigid alignment at all times by structural webbing 64. More specifically, the structural webbing holds the main bearing supports in rigid alignment at all times providing a long service life for the main bearings.

FIG. 9 shows a second embodiment of the present invention. As shown in FIG. 9, crankshaft cradle 146 includes a first eccentric member, or main bearing support 160 and a second eccentric member, or main bearing support 162. The crankshaft cradle is assembled by sliding main bearing support 160 over a first end of crankshaft 152, and sliding the second main bearing support 162 over the second end of crankshaft 152, and rigidly fastening the main bearing supports together with one or more bolts 164. The main bearing supports include structural webbing for rigid attachment of the first main bearing support to the second main bearing support. The crankshaft applies large loads on main bearings 12, and the assembled crankshaft cradle 146 holds main bearings 12 in precise alignment under the high load conditions, and more generally crankshaft cradle 146 holds main bearings 12 in precise alignment at all times.

An actuator first adjusts the rotational position of the crankshaft cradle about its pivot axis, and then locks the rotational position of the cradle in place. The actuator applies force on the cradle at a central location between the main bearings, and more generally between the front and back eccentric members, whereby twisting of the crankshaft cradle and miss alignment of the main bearings is minimized. Accordingly, the eccentric members are rigidly maintained in alignment providing a long main bearing life. Another advantage of the present invention is that the cradle has a small inertial mass, and the actuator can adjust compression ratio settings rapidly.

According to the present invention actuator power is greatly reduced by employing the downward force of on the crank pin to lever up the crankshaft main bearings. Specifically, gas force during the power stroke bears down on the crank pin acting through the piston and connecting rod. The crank pin has an orbital diameter. Power take-off from the crankshaft is through a drive gear having a pitch diameter. The gear mesh has a rotational direction pointing generally away from the piston, and applying a resistive torque on the drive gear proportional to engine power output. The pitch diameter of the drive gear is smaller than the orbital diameter of the crank pin, and at approximately 90 crank angle degrees after to dead center, the gear mesh is located approximately between the crank pin and the crankshaft axis of rotation. The downward force of the power stroke acting on the crank pin is reacted by an upward force proportional to the torque of the gear mesh. The downward force on the crank pin and the upward force of the gear torque produces an upward force of the crankshaft on the crankshaft main bearings mounted in the crankshaft cradle. A ratchet is employed for ratcheting of the crankshaft cradle and movement of the crankshaft rotational axis towards the cylinder head in steps. The present invention enables compression ratio to be changed with effectively no or almost no power loss to an actuator. Additionally, the present invention has a low cost and exceptional reliability.

Power is transferred from the crankshaft to the power take-off shaft through gears 14 and 18. According to the present invention, gears 14 and 18 have a variable centerline distance and a variable backlash value. According to the present invention, the power take-off shaft is positioned to provide a small maximum gear backlash value for a large change in compression ratio. The power take-off coupling of the present invention provides long gear life, exceptional reliability, low noise levels, and a low cost.

According to the present invention, the power take-off shaft is located within ±45° of an imaginary first plane and preferably within ±33°. The first plane passes through the crankshaft cradle pivot axis E and is perpendicular to the translation axis or centerline axis of the piston(s), providing a small change in backlash from one compression ratio setting to the next. More specifically, location of the power shaft within ±45° of the first plane, and preferably within ±33°, provides a small gear backlash, low gear noise, and long gear life. Additionally, gears 14 and 18 are mounted on parallel shafts and preferably have helical involute teeth permitting operation of the gears with small variations in centerline distance. Gears 14 and 18 are of automotive quality and have a diameter and width that provides a long gear life.

Prolonged operation of gears 14 and 18 without failure requires maintenance of parallel alignment of gear 14 and gear 18. According to the present invention, the crankshaft cradle holds the bearing elements, the crankshaft, and gear 14 in precise parallel alignment at all times with the power take-off shaft and gear 18. According to the present invention, high structural loads are applied by the crankshaft on the bearing elements, and the crankshaft cradle rigidly holds the main bearing supports in precise parallel alignment at all times preventing failure of the bearing elements and preventing failure of gears 16 and 18.

The power take-off shaft is located adjacent to crankshaft cradle in the engine housing, and is rigidly supported with only a minimal increase of engine size and weight. A further advantage of the present invention is that the power take-off shaft may also serves as a balance shaft. FIG. 9 shows an embodiment of the present invention where the power take-off shaft also serves as a balance shaft for the engine. The engine shown in FIG. 9 has a small size and low bearing and gear friction, in part because balancing and power take-off is accomplished with a single shaft.

Referring now to FIGS. 3, 4, 5 and 9, gear 14 mounted on the crankshaft transfers power from the crankshaft to a second gear 18 mounted on the power take-off shaft mounted in the engine housing. The crankshaft rotates on axis A and the power take-off shaft rotates on axis P. Axis A and axis P are separated by a centerline distance. According to the present invention, rotation of the crankshaft cradle on the pivot axis E adjusts the position of the crankshaft, adjusts the compression ratio of the engine, and changes the centerline distance between axis A and axis P, causing the backlash clearance between gear 14 and gear 18 to change. According to the present invention, a small maximum gear backlash value is provided by locating the axis of rotation of gear 18 on or near a plane that passes through the axis of rotation of the crankshaft and that is generally perpendicular to the line of translation or centerline of the first piston(s).

The power take-off arrangement according to the present invention is significantly smaller, lighter, and less costly than prior art systems for engines having eccentric main bearing supports. Additionally, the present invention provides a low friction, compact, and light weight combined balance shaft and power take-off gear set. The variable compression ratio mechanism according to the present invention holds the crankshaft main bearings in rigid alignment and provides a long bearing life. More specifically, the rigidity of the crankshaft cradle holds the bearings in alignment and prevents damage caused by bearing misalignment and vibration. The present invention is reliable and durable. The present invention can be manufactured using standard materials and mass-production methods, and has a low cost. Another advantage of the present invention is that the main bearings can be line bored, according to current manufacturing practices, to establish precise main bearing alignment. The variable compression ratio mechanism has a small inertial mass and a fast response providing rapid change of compression ratio.

According to the present invention, lowering compression ratio causes the intake valves to open earlier and the exhaust valves to close later, enabling valve to piston strike to be avoided at high compression ration, and enabling high engine power levels to be achieved at low compression ratio. According to the present invention, a drive gear on the crankshaft is in mesh with a driven gear on a second shaft. The two gears are in mesh and have a mesh direction pointing generally away from the piston. The secondary shaft drives a camshaft drive that opens and closes the intake valves. Lowering the compression ratio rotates the driven gear forward causing the intake valves to open earlier. Similarly, a drive gear on the crankshaft is in mesh with a driven gear on a third shaft. The two gears are in mesh and have a mesh direction pointing generally towards the piston. The crankshaft is located between the second and third shafts. The third shaft drives a camshaft drive that opens and closes the exhaust valves. Lowering the compression ratio rotates the driven gear on the third shaft backwards causing the exhaust valves to close later, causing the valve overlap period between the intake and exhaust valves to be increased, resulting in increased engine power. The present invention prevents valve to piston strike at high compression ratio settings. A further advantage of the present invention is that the response rate of valve phase shifting does not deteriorate with engine aging. The present invention is exceptionally robust and reliable. A further advantage of the present invention is that it is significantly less expensive than currently available variable valve control devices. Yet another advantage of the present invention is that it does not have actuator power losses.

According to the present invention, primary engine balancing is accomplished with a single balance shaft by off-setting the cylinder axis towards the primary balance shaft. Shifting the cylinder centerline axis towards the balance shaft reduces the off-set moment arm and significantly improves single balance shaft balancing of primary forces. According to the present invention, during the power stroke the crank pin rotates down between the crankshaft axis of rotation and the balance shaft axis of rotation, providing reduced frictional losses of the piston on the cylinder bore, resulting in improved fuel economy and increased power. The present invention is of immediate benefit to single cylinder motor cycle engines, with improved balance and power at no added cost after tooling an absolute certainty.

BRIEF DESCRIPTION OF THE FIGURES

FIG. 1 shows a section of the variable compression ratio engine according to the present invention. FIG. 1 also shows sectional view F1—F1 of FIG. 2.

FIG. 2 shows sectional view F2—F2 of FIG. 1. FIG. 2 shows the crankshaft, cradle, power shaft, and power output coupling.

FIG. 9 also shows a partial sectional view of engine 136 taken along cut lines F9—F9 shown in FIG. 8.

RIGID CRANKSHAFT CRADLE AND ACTUATOR

Figure 3:
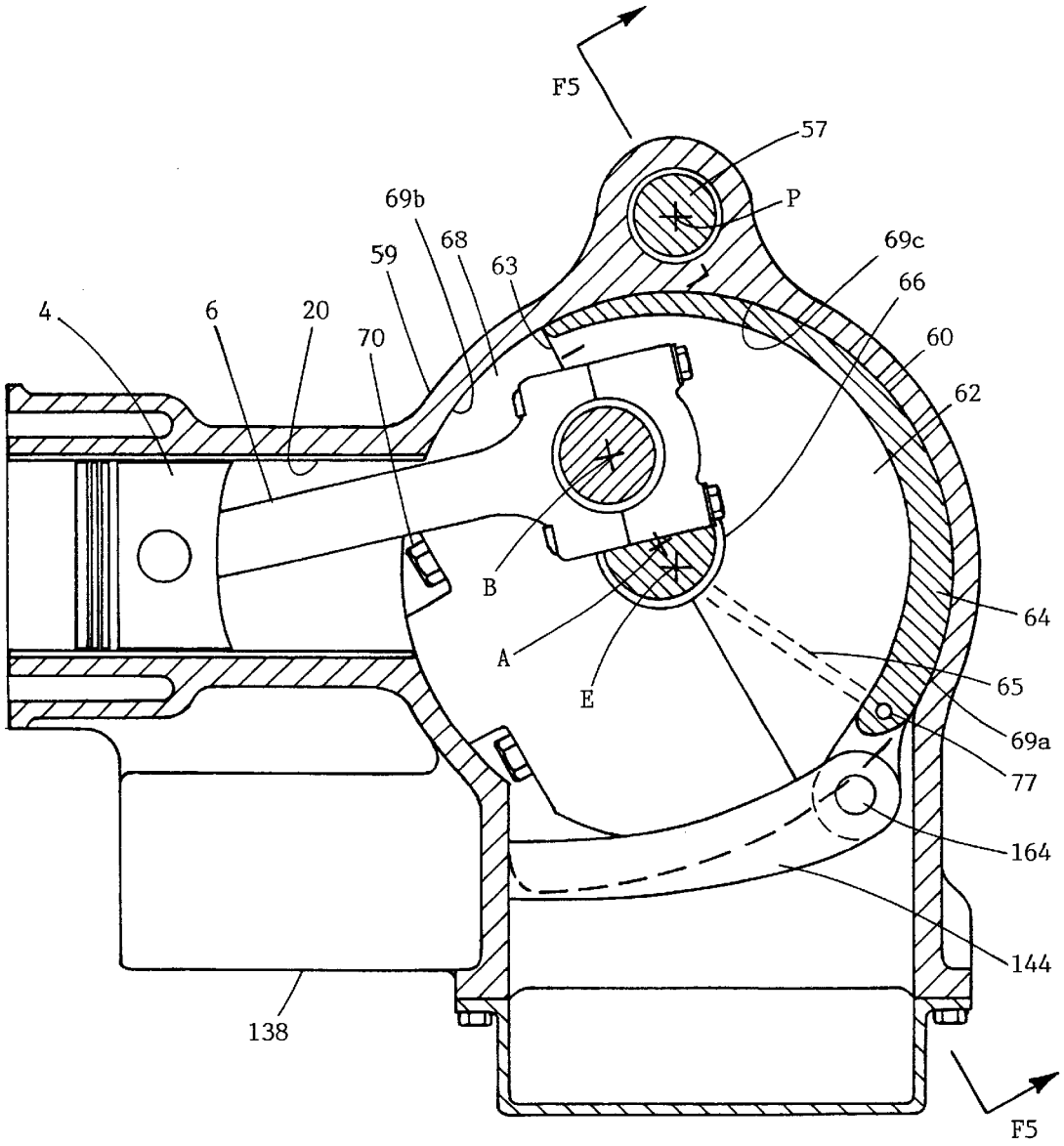
FIG. 3 shows a three cylinder engine according to the present invention.

FIGS. 1 and 2 show a portion of a variable compression ratio engine 2 according to the present invention. Engine 2 has a piston 4, a connecting rod 6, a crankshaft 8 having a crankshaft rotational axis A and having one or more crank throws or cranks 10 having a crank throw centerline B, crankshaft main bearings 12, a crankshaft power take-off gear or output gear 14, a power shaft 16 having a power shaft rotational axis P preferably parallel to crankshaft axis A, a power input gear or power shaft gear 18, a cylinder 20 having cooling means such as a water jacket 22, a housing 24, a cylinder head 26, one or more intake valves 28, one or more exhaust valves 30, fuel injection or carburetion means 32, and one or more spark plugs 34. Crank 10 has a stroke 2L equal to twice the distance from axis A to axis B. Crankshaft 8 is rotatably mounted in a ridged crankshaft cradle 36 having one or more eccentrics such as eccentrics 38 and 40. According to the present invention, engine 2 includes an actuator 42 (shown in FIG. 6) for adjusting the rotational position of a crankshaft cradle 36 on a crankshaft cradle axis or pivot axis E, and for adjusting the position of crankshaft rotational axis A relative to housing 24. More specifically, the cradle is mounted in the engine for pivoting relative to the engine about the pivot axis, the pivot axis is preferably substantially parallel to and spaced from the rotational axis of the crankshaft, and the actuator varies the position of the cradle about the pivot axis, and adjusts the compression ratio of the engine. According to the present invention actuator 42 may be a hydraulic actuator, an electro-mechanical actuator, a rotary actuator, a straight hydraulic cylinder actuator, or another type of actuator. Preferably, engine 2 is a four-stroke port fuel injected spark-ignition engine. Those skilled in the art will appreciate that according to the present invention engine 2 may be a direct fuel injection spark-ignition engine, a diesel engine, a two-stroke engine, or another type of reciprocating piston engine or variable volume machine such as a Stirling engine, a steam engine, a pump, a compressor, or an expander (all not shown), and that other effective arrangements of valving, fuel supply and ignition means may be provided and/or omitted. Those skilled in the art will appreciate that housing 24 and cylinder head 26 may be separable, a single cast part, or other functional arrangement. Piston 4 is slidably housed in cylinder 20 which is provided air through intake valve 28. Intake valve 28 may include an adjustable valve actuation mechanism 44.

Figure 7:
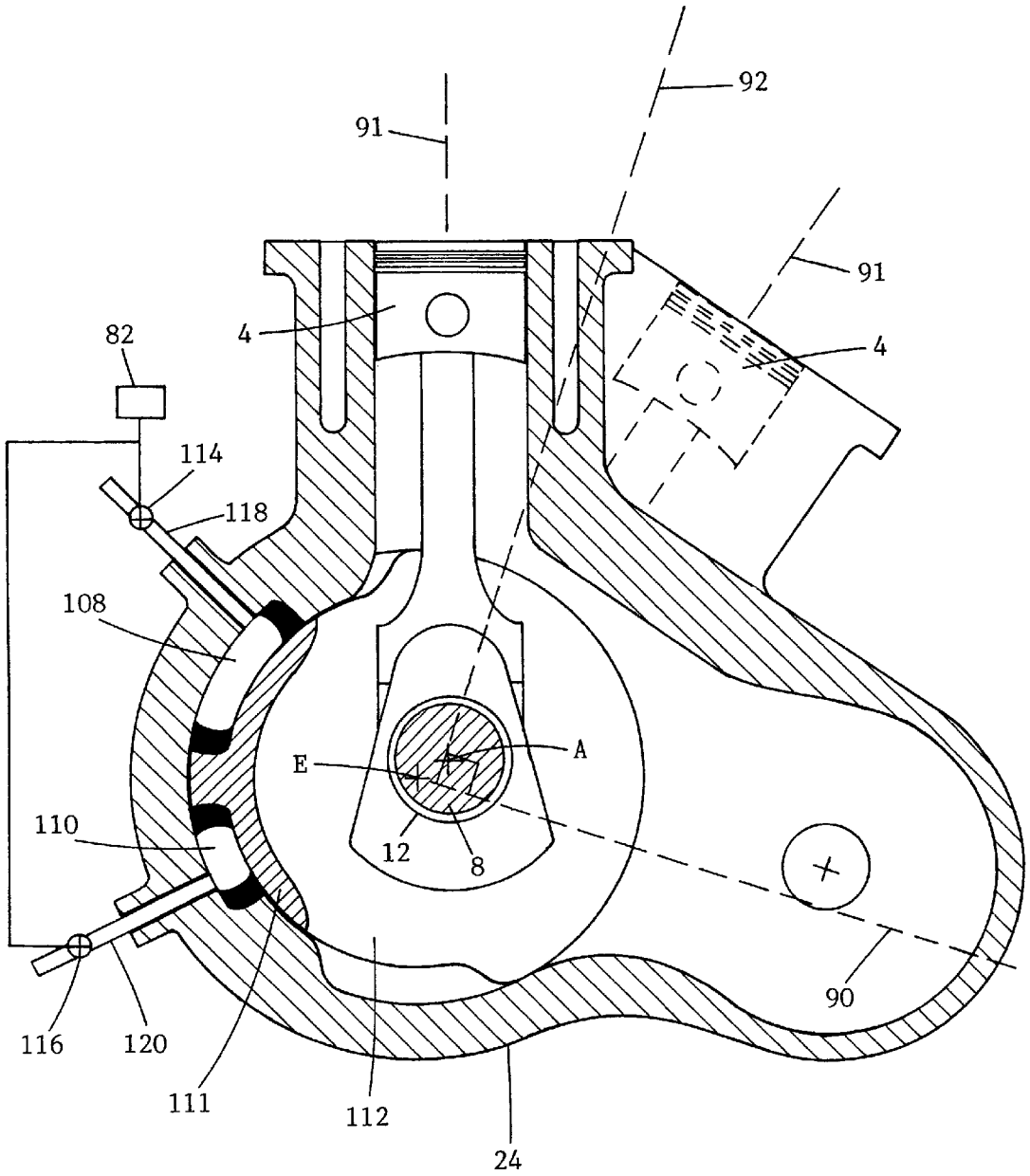
FIG. 7 is similar to FIG. 1 but shows a two cylinder engine having oil chamber 108, oil chamber 110, and crankshaft cradle 112.

Engine 2 has one or more cylinders 20. In multi-cylinder engines according to the present invention, the cylinders are preferably in-line or in a steep "V" orientation, as shown in FIG. 7, however other arrangements may be used. Referring now to the single cylinder shown in FIGS. 1 and 2, within engine 2 the geometric cylinder displacement D of the cylinder within engine 2 is equal to the product of the full stroke of piston 4 in cylinder 20 times the cross sectional area of cylinder bore 20. The engine displacement or cylinder displacement of engines according to the present invention having one or more cylinders is the sum of the geometric cylinder displacements of all of the working cylinders of the engine. Imaginary point X is located at the geometric center of the cross sectional area of cylinder bore 20, and immediately above (just out of reach of) piston 4 when piston 4 is fully extended away from crankshaft rotational axis A when engine 2 is at its highest compression ratio setting. Preferably, cylinder bore 20 is round, however cylinder bore 20 may have other cross sectional area shapes such as oval, square, or another shape. Those skilled in the art will appreciate that the top of piston 4 may be flat or have a non-flat surface. The cylinder within engine 2 has a combustion chamber volume, or end chamber volume, d having a minimum $d_{min}$ and a maximum $d_{max}$. Combustion chamber volume d is the volume between cylinder head 26 and piston 4 when piston 4 is fully extended away from crankshaft rotational axis A. Crankshaft rotational axis A has a first position located on an axis F that provides the smallest combustion chamber volume, $d_{min}$. Combustion chamber volume $d_{min}$ is the volume between cylinder head 26 and piston 4 when piston 4 is fully extended away from crankshaft rotational axis A and crankshaft rotational axis A is located on axis F (e.g., rotational axis A is at its closest position to imaginary point X). Crankshaft rotational axis A has a second position located on an axis G that provides the largest combustion chamber volume, $d_{max}$. Combustion chamber volume $d_{max}$ is the volume between cylinder head 26 and piston 4 when piston 4 is fully extended away from crankshaft rotational axis A and crankshaft rotational axis A is located on axis G (e.g., rotational axis A is at its farthest position from imaginary point X). The compression ratio C of the cylinder shown within engine 2 is equal to, $$C=(D+d)/d$$

The maximum compression ratio $C_{max}$ of the cylinder shown within engine 2 is equal to, $$C_{max}=(D+d_{min})/d_{min}$$

The minimum compression ratio $C_{min}$ of the cylinder shown within engine 2 is equal to, $$C_{min}=(D+d_{max})/d_{max}$$

Crankshaft cradle 36 is rotatably mounted in a bore 46 in housing 24. Crankshaft cradle 36 may have a first eccentric member, main bearing support or section 48 and a second eccentric member, main hearing support or section 50. Crankshaft cradle 36 has one or more eccentrics such as eccentrics 38 and 40. Eccentric 38 is formed in section 48, and eccentric 40 is formed in section 50. Section 48 includes webbing 52, and section 50 includes webbing 54. Webbing 52 and 54 rigidly connects eccentric members 48 and 50 to one another. In detail, eccentrics 38 and 40 are rigidly joined by webbing 52 and 54, and may be held in position by a fastener such as pin, clip, screw or bolt 56 and more generally eccentric member sections 48 and 50 are rigidly, and preferably removably, connected together with one or more fasteners.

Figure 4:
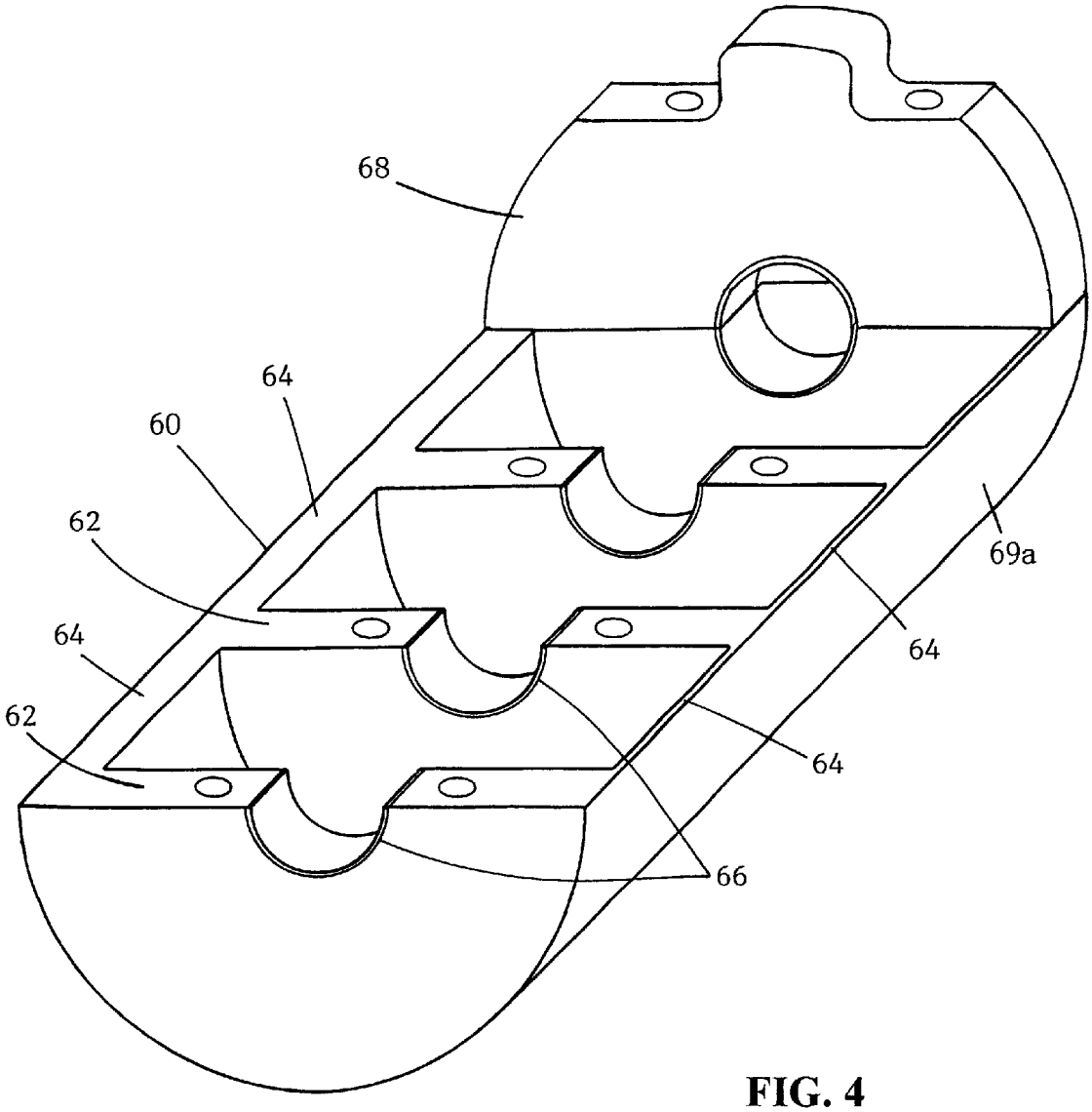
FIG. 4 shows a detailed view of the crankshaft cradle, shown in FIG. 3.
Figure 5:
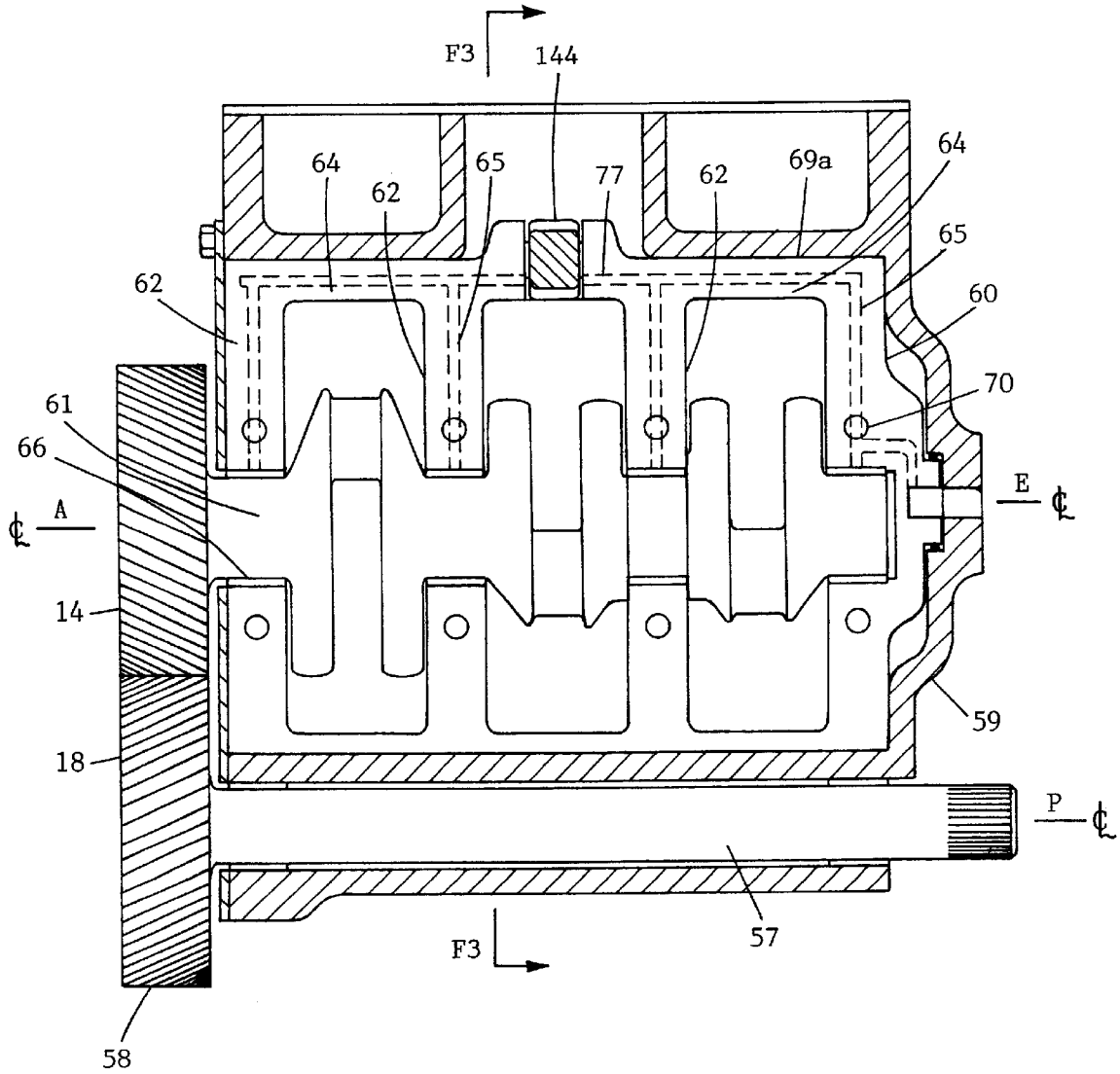
FIG. 5 shows a partial sectional view F5—F5 of FIG. 3.

Referring now to FIGS. 3, 4 and 5, in an embodiment of the present invention, crankshaft cradle 60 has eccentric members or sections 62. Adjacent eccentric members or sections 62 are rigidly joined by webbing 64. Adjacent eccentric members or sections 62 joined by webbing may be an single cast part (as shown), or may be an assembly of parts, and more specifically crankshaft cradles comprising two or more eccentric members 62 and webbing 64 may be a one-piece cast part or an assembly of parts. FIGS. 4 and 5 show four eccentric members 62 and webbing 64 cast together as one rigid part and supporting four main bearings 66. Sections 68 may serve as crankshaft main bearing caps. Bearing cap bolts or fasteners 70 rigidly and preferably removably secure said bearing caps 68 to eccentric member or sections 62. Referring now to FIGS. 1 through 5, according to the present invention, adjacent eccentric members are rigidly joined by webbing effective for rigidly holding the eccentric members and the crankshaft main bearings in alignment on crankshaft centerline axis A.

Referring to FIGS. 1 and 2, main bearings 12 are mounted or formed in eccentrics 38 and 40 for supporting crankshaft 8. Bearings 12 may be journal bearings, roller, needle, tapered, spherical, or ball bearings, or any other functional bearing means for supporting crankshaft 8 in eccentric 38 and 40. Preferably bearings 12 are separable permitting assembly of crankshaft 8 in crankshaft cradle 36. Bearings 12 may be separable by sliding sections 48 and 50 apart along axis E. Referring now to FIGS. 3, 4 and 5, bearings 66 are separable by removing bolts 70 and separating eccentric member or section 62 and bearing cap or section 68.

Referring now to FIGS. 1 and 2, crankshaft cradle 36 and eccentrics 38 and 40 rotate about a pivot axis E. According to the present invention, one or more fluid chambers 72 are formed between housing 24 (and/or housing 24 plus one or more end surfaces 74 and 76) and crankshaft cradle 36. Those skilled in the art will appreciate that other surfaces may be used to contain fluid within chamber 72. The fluid in chamber 72 is oil or a similar hydraulic working fluid. The rotational position of crankshaft cradle 36 and eccentrics 38 and 40 on pivot axis E is adjusted by adjusting the volume of chamber 72. Preferably, the fluid in chamber 72 exerts a force directly on crankshaft cradle 36, causing crankshaft cradle 36 to rotate about pivot axis E, and causing the position of crankshaft rotational axis A to be adjusted. The volume of chamber 72 is adjusted by admitting or releasing fluid from chamber 72, and in more detail by pumping fluid into chamber 72 or releasing fluid from chamber 72. Chamber 72 is in fluid communication with one or more fluid passageways 78. One or more valves 80 control flow of fluid through passageway 78 (or other passageway in fluid communication with chamber 72), and thus control flow of fluid into and out of chamber 72. Valve 80 is controlled by a controller 82 or other control means. Crankshaft cradle 36 and eccentrics 38 and 40 may rotate up to θ degrees from a first position to a second position. In the first position, crankshaft rotational axis A is located on axis F, and in the second position crankshaft rotational axis A is located on axis G. Referring now to the combustion chamber volume d shown within engine 2, releasing fluid from chamber 72 through valve 80 causes crankshaft cradle 36 to rotate (clockwise) about pivot axis E θ degrees (due to downward force on eccentric sections 38 and 40, and on crankshaft cradle 36 from crankshaft 8 and/or due to other applied forces), causing crankshaft 8 to move (be lowered) from centerline F to centerline G, causing volume d to be increased from $d_{min}$ to $d_{max}$ and causing the compression ratio C of the cylinder shown within engine 2 to be reduced from $C_{max}$ to $C_{min}$. Fluid can be pumped back into the chamber 72 to rotate crankshaft cradle 36 counterclockwise, causing the compression ratio C to be increased. Those skilled in the art will appreciate that the crankshaft rotational axis A can be adjusted to any position between axis F and axis G, and compression ratio C can be adjusted to any value between $C_{max}$ and $C_{min}$. According to the present invention, the volume of chamber 72 is adjusted to adjust the rotational position of crankshaft cradle 36 and eccentrics 38 and 40. Adjusting the rotational position of crankshaft cradle 36 and eccentrics 38 and 40 adjusts the position of crankshaft rotational axis A (e.g., the rotational centerline position of crankshaft 8) relative to housing 24, and adjusts the compression ratio C of engine 2. Those skilled in the art will appreciate that engine 2 can have one or more cylinders, and that the compression ratio C, displacement D, and combustion chamber volume d can be the same or different for each of the cylinders according to the present invention.

Figure 6:
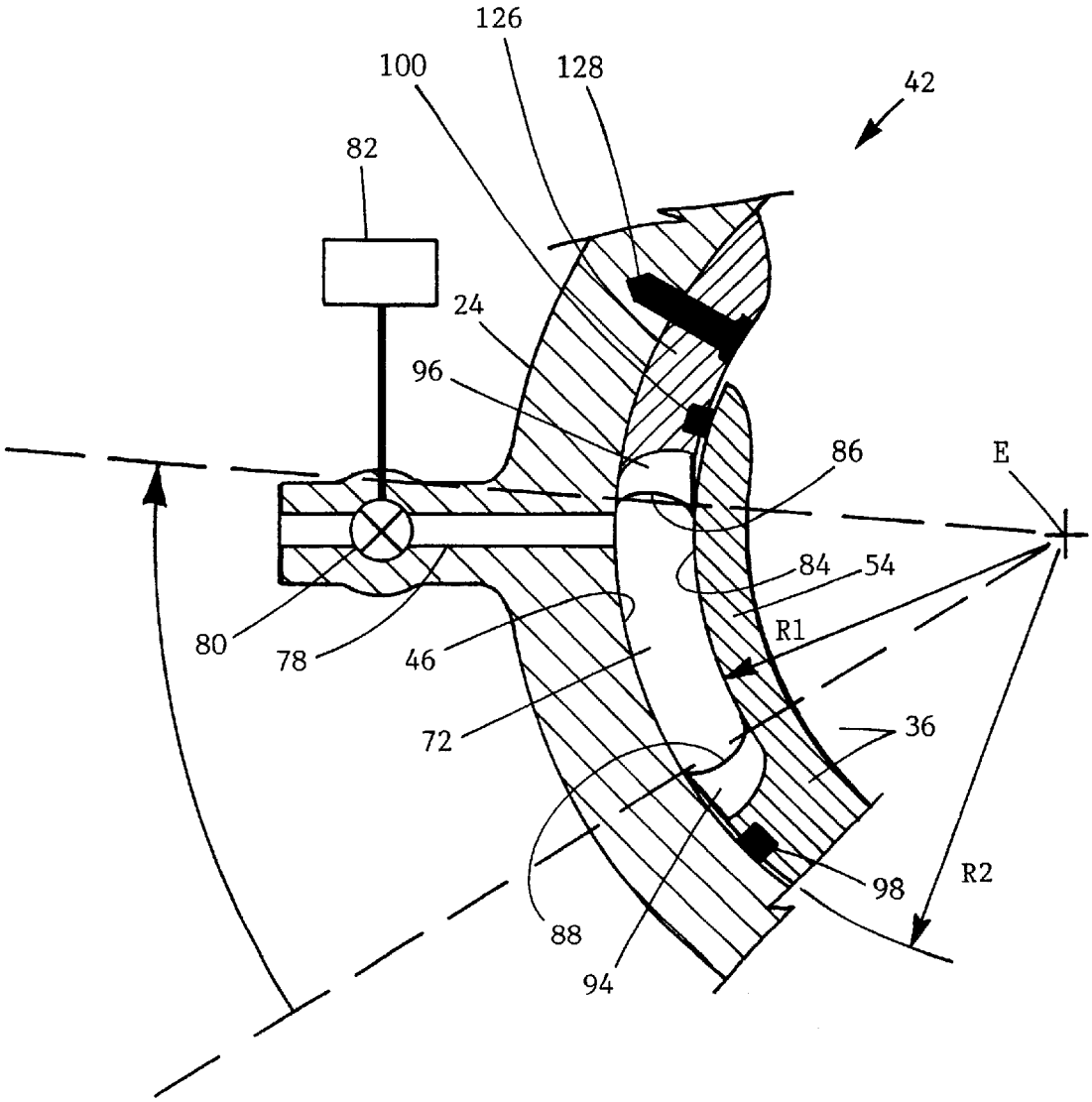
FIG. 6 is a detailed view of fluid chamber 72 shown in FIGS. 1 and 2.

FIG. 6 shows a detailed view of chamber 72, and more generally a rotary actuator 42 for rotating crankshaft cradle 36 and eccentrics 38 and 40 relative to housing 24. Referring now to FIGS. 1, 2 and 6, crankshaft cradle 36 has a surface 84 at radius R1 from pivot axis E that slidably engages a first chamber end surface 86 extending from bore 46. Surface 84 is preferably located on webbing 52 and 54. Those skilled in the art will appreciate that surface 84 may touch end surface 86, or be separated from end surface 86 by a small clearance (e.g., by a small working tolerance between parts). Chamber 72 has a second chamber end surface 88 extending from surface 84 that slidably engages bore surface 46. Those skilled in the art will appreciate that end surface 88 may touch bore 46, or be separated from bore 46 by a small clearance (e.g., by a small working tolerance between parts). Chamber 72 is formed by surface 84, bore surface 46, end surface 88, end surface 86, and a top surface 74 and a bottom surface 76. Those skilled in the art will appreciate that top surface 74 and/or bottom surface 76 may be a continuation of, or radiused from, surface 46, surface 84, surface 88, and/or surface 86.

One or more seals may be used to retain fluid in chamber 72, such as face seals 94 and 96, line seals 98 and 100, and end surface seals 102 and 104. Those skilled in the art will appreciate that other seal types and arrangements may be used to retain fluid in chamber 72. According to the present invention, hydraulic fluid in chamber 72 acts on crankshaft cradle 36. More generally, crankshaft 8 is mounted in eccentrics 38 and 40 in crankshaft cradle 36, and crankshaft cradle 36 is the rotary element of rotary actuator 42, e.g., crankshaft 8 is mounted in the rotary element of the rotary actuator. The present invention is compact in design and provides ridged support of crankshaft 8, which improves crankshaft durability and life, and reduces vibration and noise. The present invention is simple in design and inexpensive to manufacture, and has exceptional reliability and durability.

At times during operation of the present invention, the fluid in chamber 72 is at high pressure, such as during the power stroke of engine 2 when piston 4 is bearing down on connecting rod 6. During the intake stroke of engine 2, the downward motion of piston 4 and connecting rod 6 may cause crankshaft 8 to exert an upwards force on eccentrics 38 and 40, causing crankshaft cradle 36 to rotate counterclockwise, and the fluid pressure in chamber 72 to decrease. Crankshaft cradle 36 may be held in position by retaining means such as a pre-tensioning spring 106 (see FIG. 9), a second hydraulic fluid chamber (see FIGS. 7, 10, and 12), a friction brake, a sliding pin, or other means that fixes or substantially retain and/or hold firm the position of crankshaft cradle 36 relative to housing 24. Pre-tensioning spring 106 may be used to exert a clockwise torque on crankshaft cradle 36 (e.g., spring 106 moves crankshaft axis A in a direction generally away from piston 4, encouraging the compression ratio to be reduced), to minimize and/or prevent counterclockwise movement of crankshaft cradle 36 when a change of compression ratio is not being sought. Spring 106 minimizes and/or substantially prevents rotational vibration or bounce of crankshaft cradle 36 in bore 46.

FIG. 7 is similar to FIG. 1 except that FIG. 7 shows a first fluid chamber 108, a second fluid chamber 110, a crankshaft cradle 112, and webbing 111. Chamber 108 is similar to chamber 72 (shown in FIGS. 1 and 6) in that increasing the volume in chamber 108 (e.g., by pumping hydraulic fluid into chamber 108) rotates crankshaft cradle 112 counterclockwise, causing crankshaft 8 to be raised and the compression ratio C to be increased. Chamber 110 is filled with fluid to retain crankshaft cradle 112 in a fixed or near fixed position, and prevent crankshaft cradle 112 from substantively rotating or vibrating under the cyclic (and in some cases reversing) loads applied to crankshaft cradle 112 by crankshaft 8, and in more detail to retain crankshaft cradle 112 in a fixed or near fixed position except during periods when valves 114 and/or 116 are adjusted to adjust the position of crankshaft cradle 112 and main bearings 12 relative to housing 24. Chamber 110 may also be used to forcibly rotate crankshaft cradle 112 clockwise, causing crankshaft 8 to be lowered, and causing the compression ratio C to be lowered. Controller 82 and valves 114 and 116 are used to control feed of fluid into and out of chambers 108 and 110 through fluid passageways 118 and 120. Other valves and fluid passageways, and other valve and fluid passageway arrangements may be used to control the volume of fluid in chambers 108 and 110.

Referring now to FIGS. 1 and 2, power is transferred from crankshaft 8 to power take-off shaft 16 through a power output coupling 58 comprising gears 14 and 18. According to the present invention, the distance between the crankshaft rotational axis A and the power shaft rotational axis P changes as the crankshaft rotational axis A is moved and the compression ratio of the engine is changed. More specifically, the power output coupling has at least one external power take-off gear 14 on crankshaft 8 and power shaft 16 has an axis of rotation P and an external power input gear 18. External power take-off gear 14 is engaged with external power input gear 18, and crankshaft 8 has a first axial position having a first distance from power shaft axis P at a said first pivot position of cradle 36, and crankshaft 8 has a second axial position having a second distance from power shaft axis P at a second pivot position of cradle 36, and the second distance is greater than said first distance. Gears 14 and 18 are external gears (not internal or annular gears) and have involute, epicycloid or other suitable gear tooth shapes so that the durability of the gears is not substantively effected by minor changes in the centerline distance between the crankshaft 8 and the power shaft 16. Preferably gears 14 and 18 are helical gears having parallel axes of rotation, to provide a higher load carrying capacity, a higher operational speed capability, and reduced noise.

Referring now to FIGS. 1 and 7, each piston 4 in the engine has a translation axis 91. Engines according to the present invention have a mean translation axis or centerline axis 92, where the centerline axis 92 is defined as the translation axis 91 in single cylinder engines, and the bisecting or average translation axis in multi-cylinder V or W engines.

In order to minimize change in the distance between the crankshaft gear 14 and the power shaft gear 18 during changes of compression ratio, in present embodiment, axis P is positioned within plus or minus 45° of a first plane. Specifically, a first plane 90 passes through pivot axis E and is perpendicular to the centerline axis 92. A first crankshaft axis is located approximately on the first plane, said centerline axis and said crankshaft axis being on the same side of said pivot axis. A second plane **90*b* passes through the first crankshaft axis, said second plane and said first plane being separated by 45°, and a third plane 90*c* passing through said first crankshaft axis, said third plane and said first plane being separated by 45° and said second plane and said third plane being separated by 90°. Axis P is located between the second plane and the third plane, thereby minimizing the maximum backlash between the external power take-off gear and the external power input gear. Those skilled in the art will appreciate that axis P may be located to the right or left of crankshaft 8** according to the present invention. Alternatively, the first plane has its origin at, and is perpendicular to, a second plane that passes through axis F and G. Axis P is positioned within plus or minus 45° of the first plane, where the plus or minus 45° is measured from the origin of the first plane. Those skilled in the art will also appreciate that placement of axis P within plus or minus 45° of the first plane provides a minimum gear backlash in engines both having rigidly connected and not rigidly connected main bearing supports.

An anti-backlash gear 112 may be used to prevent gear chatter and wear. Anti-backlash gear 112 is spring loaded to keep the larger load bearing gear 18 in contact with its mating crankshaft gear 14 at all or almost all times. Alternatively, an anti-backlash gear may be mounted on crankshaft 8. Power shaft 16 may have one or more balance weights 124. Those skilled in the art will appreciate that the balance weight 124 is optional. According the current embodiment of the present invention, the power output of the engine is through the power shaft, since its centerline is fixed along axis P, and thus power shaft 16 can easily be coupled to a clutch, transmission or other rotating element (all not shown). Power output for boats, airplanes, and some other applications may be directly through crankshaft 8, as adjusting the centerline of crankshaft 8 may not significantly affect system performance.

Referring now to FIGS. 1, 2, and 6, preferably the engine is assembled by sliding crankshaft cradle 36 into bore 46 along axis E. Bore 46 in housing 24 can be machined at low cost, and provides ridged support of crankshaft cradle 36.

One or more parts 126 may be attached (or formed into the inside of bore 46) by a screw 128 or other attachment means such as a bolt, a slot, or adhesive. Those skilled in the art will appreciate that other parts may be attached or formed into the inside of bore 46. Attaching parts inside bore 46 (as opposed to machining forms extending inward from radius R2) enables bore 46 to be machined at low cost. An opening 130 (dashed lines) may be provided for access to bolts and for oil drainage.

A significant advantage of the present invention is that crankshaft cradle 36 and housing 24 rigidly hold crankshaft main bearings 12 in alignment (for single and multi-cylinder engines). Rigidly supporting the crankshaft main bearings 12 in alignment significantly improves crankshaft durability, and reduces noise and vibration. Those skilled in the art will appreciate that a crankshaft for a multi-cylinder/piston engine can be rigidly supported with the present invention, and for example with an eccentric that has more than two ridged crankshaft bearing supports.

In the single cylinder engine shown in FIGS. 1 and 2, crankshaft cradle sections 48 and 50 slide onto the ends of the crankshaft 8, and may also slide into bore 46. The crankshaft cradle sections 48 and 50 may be fastened together by a screw 56 or by other fastener means such as a bolt, pin, brazing, or adhesive. Preferably, end plates 132 and 134 are bolted to housing 24 to secure crankshaft cradle sections 48 and 50 in place. Endplates 132 and 134 may be used to retain crankshaft cradle sections 48 and 50 in position. Bolting endplates 132 and 134 to housing 24 may compressively set seals 102 and 104 in place. Those skilled in the art will appreciate that one or both endplates may be formed in housing 24 (for example, one or both end surfaces 76 and 74, may be machined out of housing 24), and/or other means may be used to retain crankshaft cradle sections 48 and 50 in position.

Figure 11:
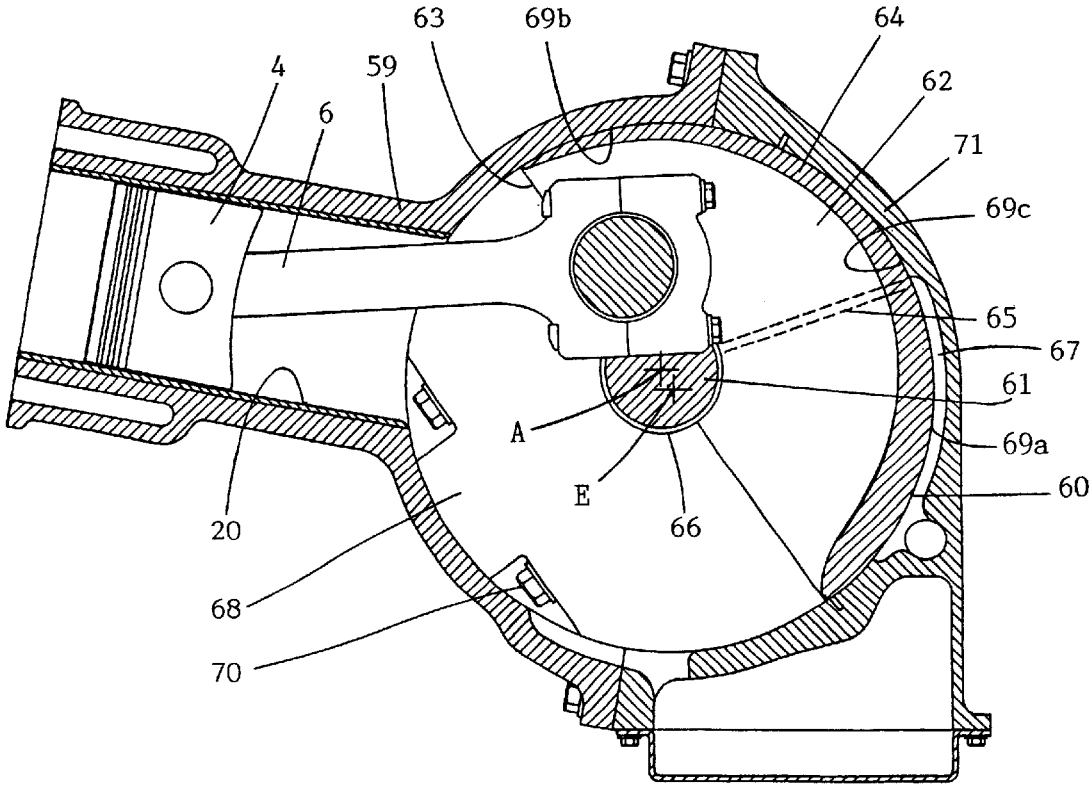
FIG. 11 is similar to FIG. 3 and shows another embodiment of the present invention.

FIG. 11 shows in sectional view part of a three cylinder variable compression ratio engine according to the present invention, having a piston 4, a connecting rod 6, a crankshaft 61 having a rotational axis A and crankshaft bearings 66, a cylinder 20, in a housing 59, an crankshaft cradle 60, and an eccentric main cap 71. Crankshaft cradle 60 comprises eccentric members or section 62 and webbing 64 rigidly connecting two or more of the eccentric members 62. Eccentric members 62 and bearing caps or sections 68 have a separation surface 63. Those skilled in the art will appreciate that separation surface 63 may be on an imaginary flat plane that bisects axis A, a curved surface that bisects axis A, or another imaginary surface that allows assembly of crankshaft 61 into crankshaft cradle 60. Sections 62 and 68 are joined by bolts or fastener 70 or other functional means. Crankshaft cradle 60 is rotatably supported in housing 59 by eccentric main cap 71. Removable main cap 71 enables crankshaft cradle 60 to be laid into the housing as an alternative to the slide-in assembly described above. Specifically, FIG. 1 shows a rigid engine construction having a housing 24 having an upper housing portion 24*a* and a lower structure 24*b*, where the upper housing portion 24*a* and the lower structure 24*b* is a one-piece metal casting, and eccentric members 48 and 50 slide into housing 24 on axis E. Bore 46 may be formed in lower structure 24*b*, or lower structure 24*b* may support a bearing element having a bore 46 for supporting the cradle (not shown). Referring now to FIG. 11, an oil feed line 65 in section 62 and an oil supply galley 67 provide oil to crankshaft bearings 66. Galley 67 is preferably about as wide as it is deep. Referring now to FIGS. 3 and 5, oil feed line 77 is in webbing 64 and oil feed line 65 is in eccentric member 62.

FIG. 4 shows a detailed view of cradle or crankshaft cradle 60. Crankshaft cradle 60 has eccentric members or sections 62 for rigidly supporting crankshaft bearings 66. Eccentric members or sections 62 are rigidly joined or connected to one another by cross webbing structure 64. Referring now to FIGS. 1 and 2, eccentric members or sections 48 and 50 are rigidly joined or connected to one another by cross webbing 52 and 54. According to the present invention, crankshaft cradle 36 includes cross webbing structure 52 and 54 effective for rigidly holding crankshaft main bearings 12 in alignment, and crankshaft cradle 60 includes cross webbing structure 64 effective for rigidly holding crankshaft main bearings 66 in alignment.

Referring now to FIGS. 3, 4 and 11, cross webbing structure 64 has an outer surface 69*a* that bears on a bore surface in housing 59 including an inner housing surface 69*b* and on an inner main cap surface 69*c*. Crankshaft cradle 60 having outer surface 69*a* is rotatably mounted inside said bore surface in housing 59 and/or eccentric main cap 71. Outer surface 69*a* may extend onto the outer surface of webbing structure 64, and outer surface 69*a* may form a continuous surface between adjacent eccentric members or sections 62 (shown). According to the present invention, crankshaft cradle 60 may be supported along all or a portion of bearing surface 69*a*.

Figure 8:
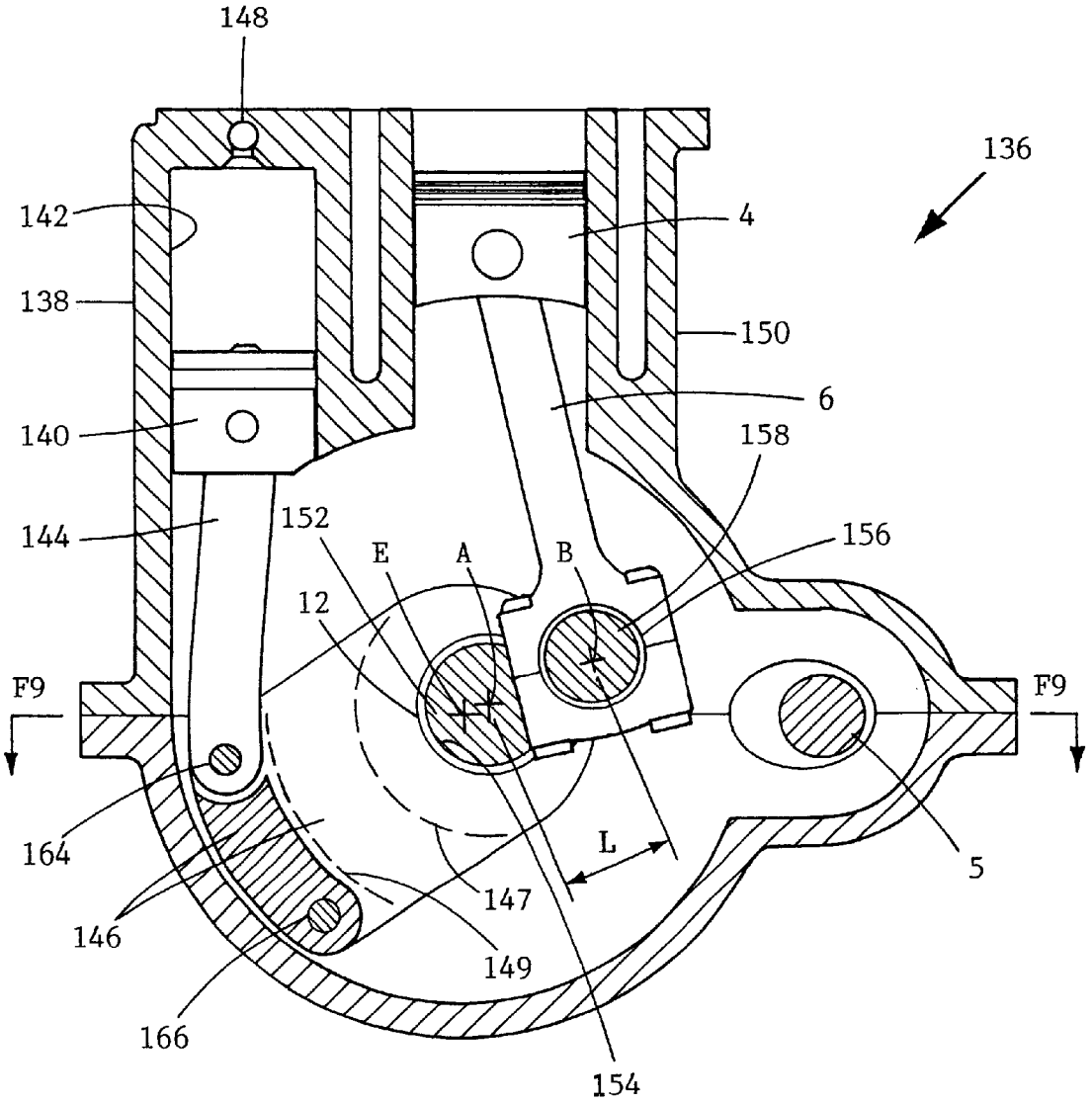
FIG. 8 shows a partial sectional view of an engine according to the present invention.

FIG. 8 shows a partial sectional view of an engine 136 according to the present invention. FIG. 8 is similar to FIG. 1 except that FIG. 8 shows a piston type hydraulic actuator 138 having a hydraulic piston 140 slidably housed in a hydraulic cylinder 142 for linear translation movement. Piston 140 is pivotaly connected to an actuator link or arm 144, and arm 144 is pivotaly connected to a crankshaft cradle 146. Piston 140 may be connected to cradle 146 by actuator link or arm 144 or by another type of coupling such as a rack and pinion gear set, an eccentric bushing between arm 144 and bolt or pin 164, or another functional arrangement. Fluid enters and exits cylinder 142 through one or more passageways 148, and flow of fluid into and out of cylinder 142 is controlled by one or more valves (not shown). According to the present invention, pressurized fluid entering cylinder 142 through passageway 148 forces piston 140 and arm 144 in a generally downward direction (with respect to the orientation of engine 136 shown in FIG. 8) causing crankshaft cradle 146 to rotate counterclockwise about axis E causing crankshaft centerline A to rise and the compression ratio of engine 136 to be increased.

Figure 9:
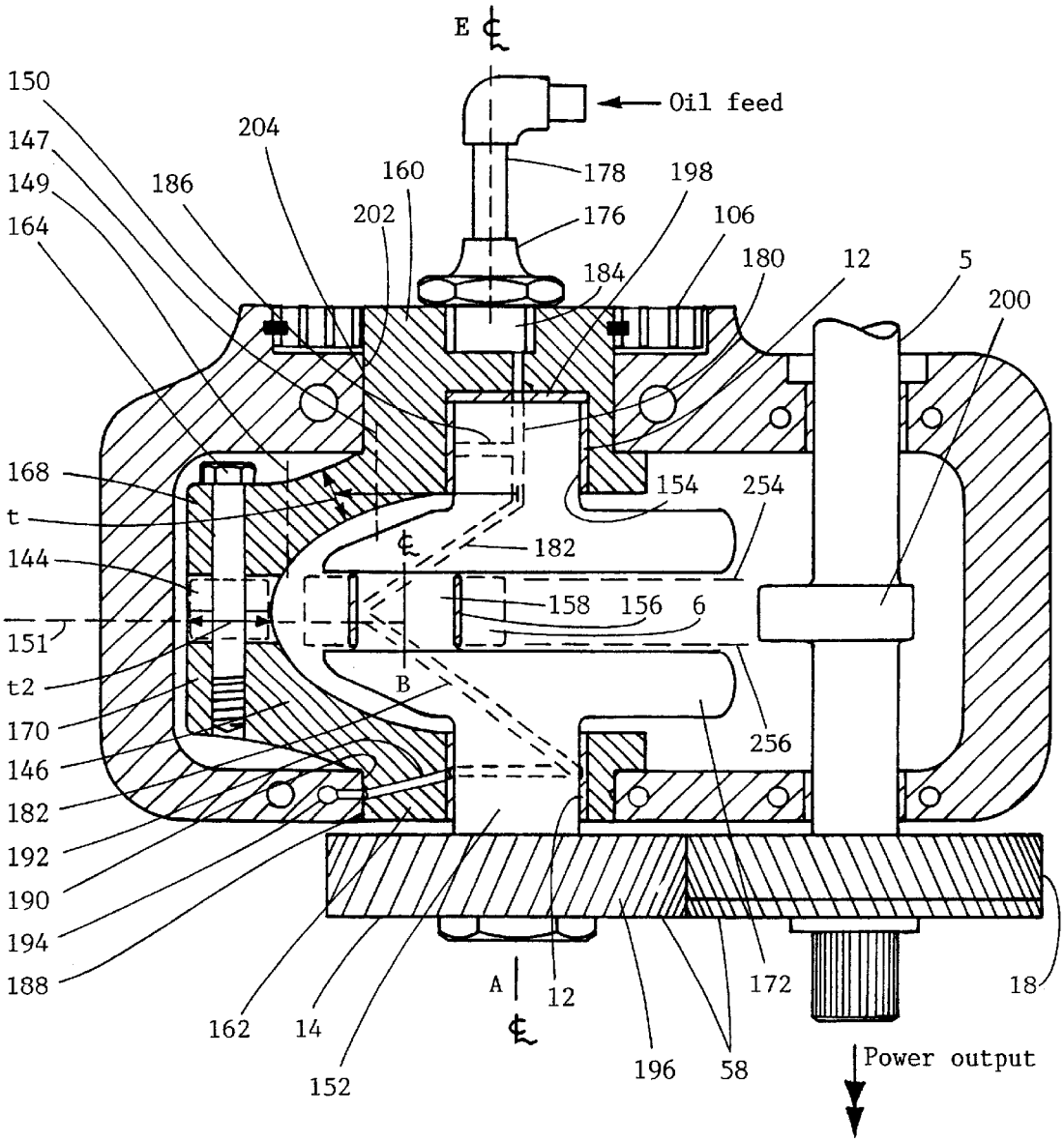
FIG. 9 shows a partial sectional view of an engine according to the present invention.

An actuator first adjusts the rotational position of the crankshaft cradle about its pivot axis E, and then locks the rotational position of the cradle in place. Referring now to FIGS. 2, 5 and 9, according to the present invention, the actuator is preferably connected to the middle of the crankshaft cradle, e.g., between the front and the back main bearings (e.g., between the two main bearings that are spaced farthest apart) and more generally between the front and back eccentric members or main bearing supports (e.g., between the two eccentric members that are spaced farthest apart), providing a centrally applied force on the cradle, whereby twisting of the crankshaft cradle and misalignent of the main bearings is minimized. FIG. 9 shows placement of actuator arm 144 between the main bearings 12 and more generally between eccentric members 160 and 162, providing balanced loading of actuator force on crankshaft cradle 146. FIG. 5 shows placement of actuator arm 144 between the main bearings 66 and more generally between the two eccentric members 62 spaced farthest apart, providing balanced loading of actuator force on crankshaft cradle 61. FIG. 2 shows the fluid chamber of an actuator 42 applying even pressure on crankshaft cradle 36 along its length, and more generally between eccentric members 48 and 50. Accordingly, the eccentric members are rigidly maintained in alignment providing a long main bearing life.

FIG. 9 shows a partial sectional view of engine 136 taken along cut lines F9—F9 shown in FIG. 8. Referring now to FIGS. 8 and 9, engine 136 has a housing 150, a piston 4, a connecting rod 6, a crankshaft 152 mounted in bearings 12 having an inner diameter 154 for carrying crankshaft 152, and bearings 12 are housed in crankshaft cradle 146. Hydraulic cylinder 142 is formed in or rigidly aligned with housing 150. Connecting rod 6 has a big-end bearing 156, and is rotatably mounted on crankshaft 152 on crank 158 having a bearing axis B. Preferably crankshaft cradle 146 has a first eccentric section 160 and a second eccentric section 162 that slide onto opposite ends of crankshaft 152, and are rigidly held together by one or more fasteners such as bolts 164 and 166, or by other means such as a pin or screw. Section 160 includes a first structure 168 for retaining bolts 164 and 166, and section 162 includes a second structure 170 for retaining bolts 164 and 166. Bolt 164 may serve as a connecting pin, linking or pivotaly connecting arm 144 and crankshaft cradle 146. Preferably, bolt 164 serves as a connecting pin and is generally centered between section 160 and section 162, so that force from arm 144 is substantially applied equally to sections 160 and 162 in order to minimize misalignment of bearings 12. In detail, the connecting pin portion of bolt 164 is located in the axial direction along axis E between sections 160 and 162, and is located in the radial direction outside the swept path of crankshaft 152, connecting rod 6 (including the connecting rod big end bearing cap), and counterweights (172 shown in FIG. 9). Crankshaft 152 may have counterweights 172. In FIG. 8, counterweights 172 are not shown (i.e. cut away) to show bearing 156 at the big end of rod 6, and the crankshaft main bearings 12. As shown in FIG. 9, a pre-tensioning means in the form of a spring 106 applies a torque on crankshaft cradle 146. Spring 106 may be attached directly to crankshaft cradle 146 and housing 150. Preferably, spring 106 is coiled around axis E and attached to an end of crankshaft cradle 146. Referring now to FIGS. 8 and 9, spring 106 exerts a clockwise torque on crankshaft cradle 146, and encourages or causes the compression ratio of engine 136 to be decreased, and more specifically spring 106 exerts a torque on crankshaft cradle 146 causing (or encouraging) crankshaft cradle 146 to rotate causing crankshaft 152 to move in a direction away from piston 4 (e.g., causing or encouraging the compression ratio of engine 136 to be reduced). Hydraulic pressure in cylinder 142 acts against (e.g., resists) the torque on crankshaft cradle 146 from spring 106, and encourages or causes the compression ratio of engine 136 to be increased.

Oil is fed to bearings 12 and 156 through an oil supply fitting 176 preferably located on axis E and having an oil feed passageway 178, that is in fluid communication with oil feed lines (e.g., crankshaft passageways) 180 and 182. Preferably oil feed line 180 is located or centered on axis A, supply fitting 176 is located or centered on axis E, and supply fitting 176 is attached directly to section 160. An off-set passageway or eccentric transition space 184 connects feed line 180 and oil feed passageway 178 in fitting 176. Supply fitting 176 may include a rotary fitting or joint so that oil feed passageway 178 may remain stationary when section 160 and crankshaft cradle 146 rotate. During operation of the present invention, oil enters passageway 178 and flows into off-set passageway 184. The oil then flows to bearings 12 and 156 through passageways 180, branch passageway 186, and 182. Those skilled in the art will appreciate that other fluid passageway arrangements may be used according to the present invention to deliver oil to bearings 12 and 156. Surfaces 188 and 190 may be lubricated by feed line 192 and/or 194.

Gear 14 may have a helical or bevel tooth pattern 196 that pushes crankshaft cradle 146 in the direction of fitting 176. Crankshaft cradle 146 may have or bear on a thrust bearing 198 that resists axial thrust exerted by gear 14 or other axial thrust forces from other sources. Those skilled in the art will appreciate that other types of thrust bearings may be used according to the present invention.

Gear teeth 196 bearing down on power shaft gear 18 result in a reactionary upward force on gear 14 and crankshaft 152. The present invention includes a ridged crankshaft cradle 146 and a stiff housing 150 to prevent crankshaft cradle 146 from twisting under these and other forces and loads.

The crankshaft cradle may be fabricated in cast iron, steel, aluminum, magnesium, titanium, or another material or combination of materials to provide ridged support of the crankshaft main bearings. Axis B and axis A are separated by length L. The stroke of the crank throw is 2L. The stroke of engine 136 is approximately 2L, and varies slightly because the cylinder axis does not intersect the crankshaft axis for all compression ratio settings. In general, the stroke of engine 136 is assumed to be 2L, with minor variances in stroke length ignored.

Figure 12:
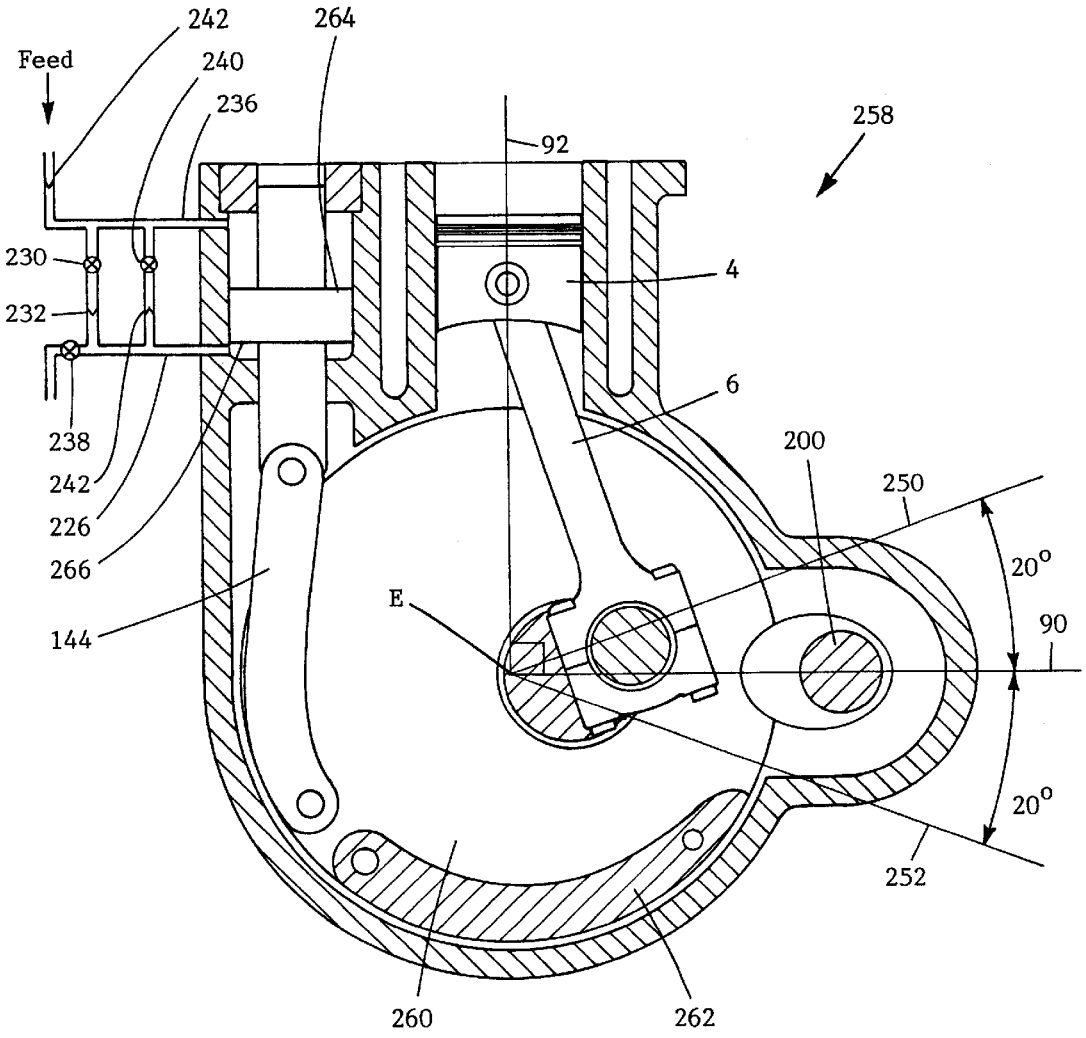
FIG. 12 shows a partial section of an engine according to the present invention having a close spacing between the crankshaft and the power shaft.

Referring now to FIGS. 7 and 12, during the operation of the engine, the movement of the connecting rod defines a connecting rod swept path. The webbing and eccentric members are located entirely outside the connecting rod swept path to prevent mechanical interference. According to the present invention, the engine may have a clearance zone to minimize crankshaft cradle mass and/or to provide clearance around a balance shaft 200 and/or the power shaft 5. In detail, according to the present invention, each piston has a translation axis, and the engine has a mean translation axis or centerline axis 92, where the centerline axis is defined as the translation axis in single cylinder engines, and the bisecting or average translation axis in multi-cylinder V or W engines. Engine 258 has a cradle 260, webbing 262, a first plane 90 originating at pivot axis E and passing through centerline axis 92, the first plane and the centerline axis being perpendicular. The engine has a second plane 250 originating at pivot axis E, the second plane being separated from the first plane 90 by 20 degrees, and the engine has a third plane 252 originating at pivot axis E, the third plane and the first plane being separated by 20 degrees, and said second plane 250 and said third plane 252 being separated by 40 degrees. The connecting rod swept path is bound by a fourth plane 254 and a fifth plane 256 (see FIG. 9), said fourth and said fifth planes being perpendicular to the rotational axis of the crankshaft. Engine 258 has a clearance zone bound by the second plane 250 and the third plane 252 and by the fourth plane 254 and the fifth plane 256, and the webbing 262 is located exclusively outside of said clearance zone at all compression ratio settings, providing a mechanical clearance between the crankshaft cradle and balance shaft 200, power shaft 5, and/or other engine components.

Referring now to FIG. 9, to provide ridged support of crankshaft bearings 12, crankshaft cradle 146 has a maximum thickness t between a first circle or cylinder 147 and a second circle or cylinder 149. The first circle 147 has a center on the rotational axis of the crankshaft A and has a diameter of 1.2 times the stroke of the crank throw, and the second circle 149 has a center on the rotational axis of the crankshaft A and has a diameter of 2.0 times the stroke of the crank throw. Preferably, the maximum thickness between the first and second circle is at least 0.10 times the thickness of the stroke of the crank throw providing a rigid cradle. Preferably, the maximum thickness along the first circle is also at least 0.10 times the length of the stroke of the crank throw. According to the present invention, the ratio of the thickest section t of crankshaft cradle 146, between circles 147 and 149, divided by length L is greater than 0.10, (e.g., t/L>0.10) providing ridged support of main bearings 12.

Similarly, the crankshaft cradle has a second maximum thickness t2 on a plane 151 perpendicular to the rotational axis A of the crankshaft and passing through the crank throw 158. The second maximum thickness t2 is at least 0.10 times the length of said stroke providing a rigid cradle (e.g., t2/L>0.10)

As stated before, the crankshaft cradle may be a one-piece cast part, or an assembly of parts. Preferably, the webbing has a first portion, and the first portion has a thickness at a radial distance from the rotational axis of the crankshaft greater than the stroke, wherein a first eccentric member and the first portion is a one-piece metal casting, providing a rigid structure between the eccentric member and the webbing used to join adjacent eccentric members.

To provide low mechanical forces on the cradle, and a high vibrational natural frequency of the cradle (higher than the maximum operational speed of the engine), preferably the distance between the pivot axis and the crankshaft axis is at a minimum. Specifically, preferably the pivot axis passes through the swept path of the connecting rod.

In any event, crankshaft cradle 146 provides ridged support of bearings 12, and more specifically crankshaft cradle 146 holds bearings 12 in alignment within a tight tolerance, where the tight tolerance is small enough to prevent failure of bearings 12 or failure of crankshaft 152. In engines according to the present invention having two or more main bearing supports, and preferably engines with journal bearings according to the present invention, the tight tolerance is preferably a radial deflection of less than 0.008 inches (and preferably less than 0.004 inches) of the centerline of any one bearing 12 from the centerline of crankshaft cradle 146, and more specifically, measured from a zero deflection baseline where crankshaft bearings 12 are on a first straight axis of rotation and the crankshaft is on a second straight axis of rotation that is concentric with the first axis of rotation. Those skilled in the art will appreciate that the present invention provides a tight tolerance for crankshaft cradles that support crankshafts for one or more cylinder engines. In vehicles (such as in light duty passenger cars and light trucks as defined by the U.S. Environmental Protection Agency) applications of the present invention, crankshaft cradle 146 has a rigidity great enough to prevent failure of bearings 12 within a minimum of 100,000 miles of vehicle use. Light duty passenger car and truck engines are operated at part load most of the time. According to the present invention, bearing alignment is measured at a first engine setting having a crankshaft rotational speed between 1200 rotations per minute (rpm) and 6000 rpm, and at an engine mean effective pressure (mep) of less than 500 kilopascals (500 kPa). Mean effective pressure is defined on page 50 of Internal Combustion Engine Fundamentals, John, B. Heywood, McGraw-Hill Book Company, 1988, as follows, $$\text{mep(kPa)}=P(\text{kW})n_R\times10^3/V_d(\text{dm}^3)N(\text{rev}/s)$$

$n_R$ is equal to two (2) for four-stroke engines and one (1) for two-stroke engines. $V_d$ is swept engine displacement. N is engine rotational speed in revolutions per second, and P is power in kilowatts. More specifically, the first bearing has a first centerline axis and the second bearing has a second centerline axis, and the crankshaft cradle has sufficient rigidity to maintain the first and the second centerline axes within 0.008 inches of one another during operation of the engine at the first engine setting.

Engines having no more than two main bearing supports require less precise alignment of the main bearings, because a small amount of bearing misalignment does not apply a bending moment along the length of the crankshaft (i.e., a straight crankshaft axis can, in some cases, lie between two miss aligned bearing supports, but not between three miss aligned bearing supports). According to the present invention, for engines having no more than two crankshaft main bearing supports, the crankshaft cradle has sufficient rigidity to maintain said first and second centerline axes within 0.040 inches of one another during operation of the engine at said first engine setting. The engine is considered to have two crankshaft bearing supports if the two bearing supports support more than 85 percent of the crankshaft's radial load. Similarly, the crankshaft cradle has sufficient rigidity to limit rotation of the first bearing support or eccentric member relative to the second bearing support or eccentric member about the pivot axis of the cradle to one rotational degree (1°) about pivot axis E at said first engine setting. Crankshaft cradles having roller bearings, such as ball bearings, also require less precise alignment of the eccentric main bearing supports.

Referring now to FIGS. 8 and 9, crankshaft cradle 146 has a low rotational inertia, enabling actuator 138 to rapidly rotate crankshaft cradle 146 about axis E and to rapidly adjust the position of crankshaft centerline axis A. Eccentric section 160 has an outer or bearing diameter 202 that is rotatably housed in a bore 204 in housing 150, and eccentric section 162 has an outer or bearing diameter 190 that is rotatably housed in a bore 188 in housing 150. According to an embodiment of the present invention, to provide a low rotational inertia and a fast response, the ratio of inner diameter 154 to outer diameter 202 is greater than 0.40, and preferably greater than 0.30. Inner bearing diameter 154 refers to the effective diameter and more specifically the diameter of the hydraulic film separating the crank throw from the journal bearing element 12. For crankshaft cradles having roller bearings supporting the radial loads of the crankshaft, such as ball, cylindrical (including needle), tapered, and spherical roller bearings, the effective diameter is the circular path of the individual axes of rotation of the rolling elements. In the case of tapered, spherical, multiple row bearings, and other roller bearings having a range of circular path diameters, the circular path is measured from the largest circular path of the individual axes of rotation of the rolling elements. (Dampers, such as dampers 210 and 212, may be used to dampen deceleration of crankshaft cradle 214, shown in FIG. 10.)

Figure 10:
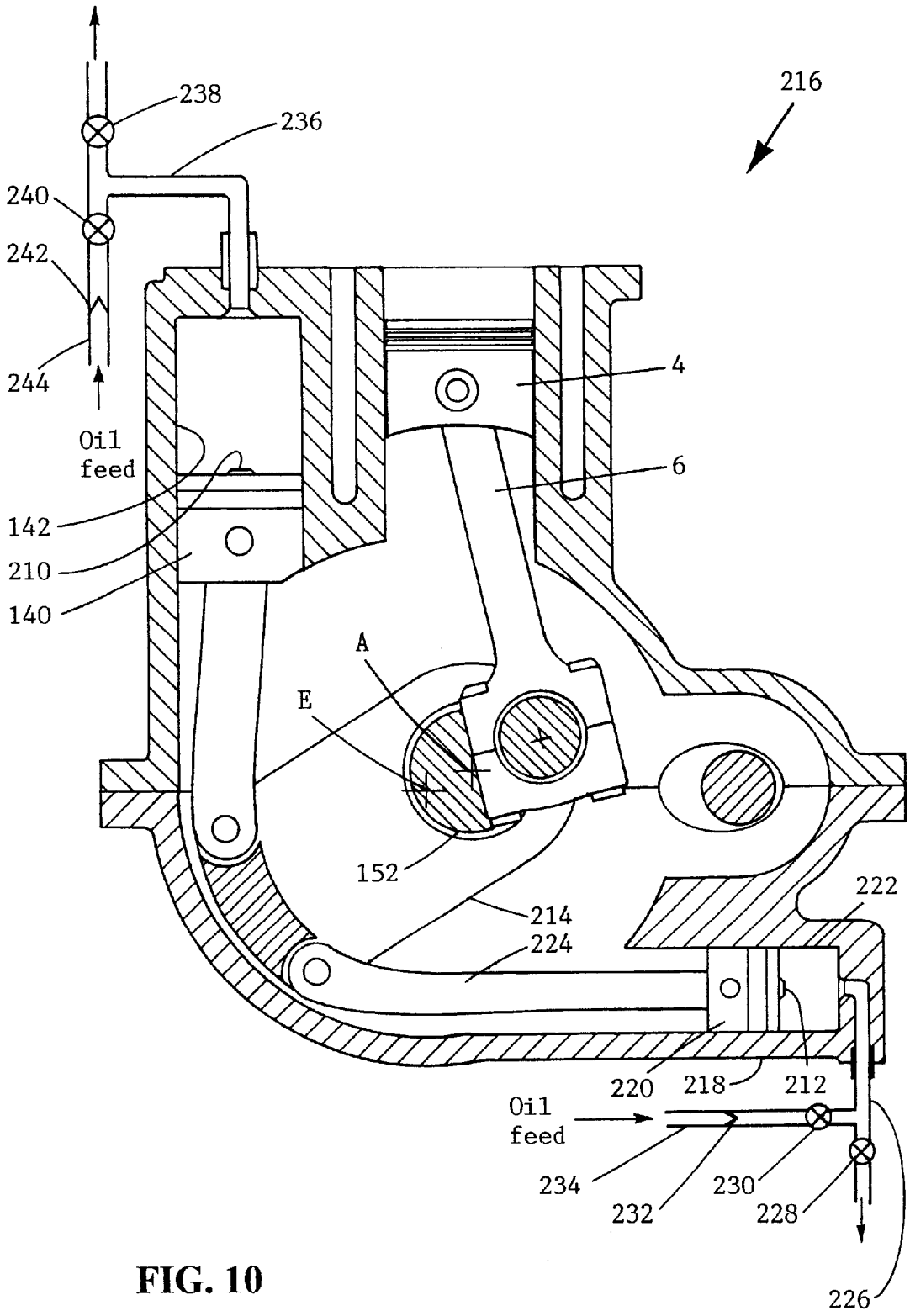
FIG. 10 shows a partial sectional view of an engine according to the present invention having a first actuator having a connecting arm and a second actuator having a connecting arm, for adjusting and retaining the position of the crankshaft cradle.

FIG. 10 shows a partial sectional view of an engine 216 according to the present invention. FIG. 10 is similar to FIG. 8 except that FIG. 10 shows a second hydraulic actuator 218 having a piston 220 slidably housed in cylinder 222. Piston 220 is pivotally connected to an arm 224, and arm 224 is pivotaly connected to a crankshaft cradle 214. Cylinder 222 has a fluid line 226, in fluid communication with a first valve 228 and a second valve 230. Second valve 230 may include a first check valve 232. Check valve 232 is in fluid communication with a pressurized oil feed line 234 which receives oil under pressure from the oil pump of the engine. Cylinder 142 has a fluid line 236, in fluid communication with a third valve 238 and a fourth valve 240. Fourth valve 240 may include a second check valve 242. Check valve 242 is in fluid communication with a pressurized oil feed line 244 which receives oil under pressure from the oil pump of the engine. Oil passing through valves 228 and 238 returns to the engine sump for eventual recirculation by the pump of the oil pump of the engine.

According to the present invention, crankshaft cradle 214 is rotated counterclockwise and crankshaft centerline axis A is moved towards piston 4 by opening first valve 228, opening fourth valve 240, closing second valve 230, and closing third valve 238. The position of crankshaft cradle 214 and crankshaft centerline axis A is retained in a fixed or near fixed position by closing first valve 228, leaving closed second valve 230 (optional), leaving closed valve third valve 238, and leaving open valve 240. Pressurized oil flows into cylinder 142 through feed line 244, check valve 242, fourth valve 240, and fluid line 236, causing crankshaft cradle 214 to rotate counterclockwise and piston 220 to compress oil retained in cylinder 222, where the position of crankshaft cradle 214 becomes fixed or nearly fixed when the pressurized oil entering cylinder 142 through feed line 236 can no longer rotate crankshaft cradle 214 counterclockwise due to the pressure of the oil in cylinder 222, and check valve 242 substantially prevents crankshaft cradle 214 from rotating clockwise. According to the present invention crankshaft cradle 214 is rotated clockwise, and crankshaft centerline axis A is moved away from piston 4 by closing first valve 228, closing fourth valve 240, opening second valve 230, and opening third valve 238. The position of crankshaft cradle 214 and crankshaft centerline axis A is retained in a fixed or near fixed position as described above, or by leaving closed first valve 228, leaving closed fourth valve 240, and closing third valve 238. Those skilled in the art will appreciate that the valve opening and closing sequences used to adjust and fix the position of crankshaft cradle 214 in engine 216, may be used to adjust the position of crankshaft cradle 112 shown in FIG. 7. Other valve opening and closing sequences may be used to adjust and fix the position of crankshaft cradle 214 in engine 216, and other types of valves may be used to control flow of fluid into and out of cylinders 142 and 222 according to the present invention. The position of crankshaft cradle 214 and crankshaft centerline axis A may also be retained in a fixed or near fixed position by closing first valve 228, opening second valve 230, closing valve third valve 238, and opening fourth valve 240.

Referring now to FIG. 10 (the embodiment shown in FIG. 7 may be operated in a similar manner), according to the present invention feed lines 244 and 234 are pressurized. Preferably standard oil pressure from engine 216 (e.g., below 100 psi.) may be used to rotate crankshaft cradle 214 and adjust the position of crankshaft centerline axis A. According to the present invention, the reversing loads on crankshaft cradle 214 from the reciprocating motion of piston 4 and connecting arm 6 may be used to rotate crankshaft cradle 214 counterclockwise about axis E and move crankshaft centerline axis A in a direction generally towards piston 4, and in some embodiments of the present invention making possible operation of the present invention with small diameter hydraulic pistons 140 and 220, and standard or near standard oil pressure. According to the present invention, the piston and connecting rod exert forces that change in magnitude on the crankshaft cradle during the induction and power strokes of the engine, and the check valve admits and retains fluid in the actuator during the induction stroke of the piston, causing the compression ratio to ratchet up. Specifically, crankshaft cradle 214 is rotated counterclockwise about axis E and crankshaft centerline axis A is moved in a direction generally towards piston 4 by closing valve 230, opening valve 228, closing valve 238, and opening valve 240. During the intake or induction stroke of engine 216, the downward motion of piston 4 and connecting rod 6 causes crankshaft 152 to exert an upwards force on crankshaft cradle 214, causing crankshaft cradle 214 to rotate counterclockwise, and fluid to flow out of cylinder 222 through valve 228, and fluid to flow into cylinder 142 through valve 240. Check valve 242 prevents fluid from leaving cylinder 142 during the power stroke of piston 4 when the force on crankshaft cradle 214 and crankshaft 152 from piston 4 and connecting rod 6 reverses and encourages crankshaft cradle 214 to rotate in a clockwise direction about axis E. Accordingly, the position of crankshaft centerline axis A ratchets up in steps, moving in a direction generally towards piston 4. When a desired position of crankshaft centerline axis A is reached, crankshaft cradle 214 may be retained in position by closing valve 228 (and optionally opening valve 230). The embodiments of the present invention just described work best with engines where the forces on crankshaft 152 reverse direction, such as in single cylinder engines and some multi cylinder engines, however, the forces on crankshaft 152 do not have to reverse for the rotational position of the crankshaft cradle to be adjusted according to the present invention, as the oil pressure in feed line 244 will encourage crankshaft cradle 214 to rotate in a counterclockwise direction when the pressure in cylinder 142 falls below the pressure in feed line 244. Preferably, pressure in line 244 is greater than in cylinder 142 when crankshaft cradle 214 is rotating counterclockwise, to support rotation of crankshaft cradle 214 and to prevent cavitation of oil in cylinder 142. Moving crankshaft centerline axis A in a direction generally away from piston 4 may be accomplished by closing valve 240, opening valve 238, closing valve 228, and opening valve 230.

Referring now to FIG. 12, preferably the first hydraulic piston 264 has the same area as the second piston 266, and fluid from the first hydraulic cylinder is directed directly into the second hydraulic cylinder, thereby preventing cavitation.

Figure 14:
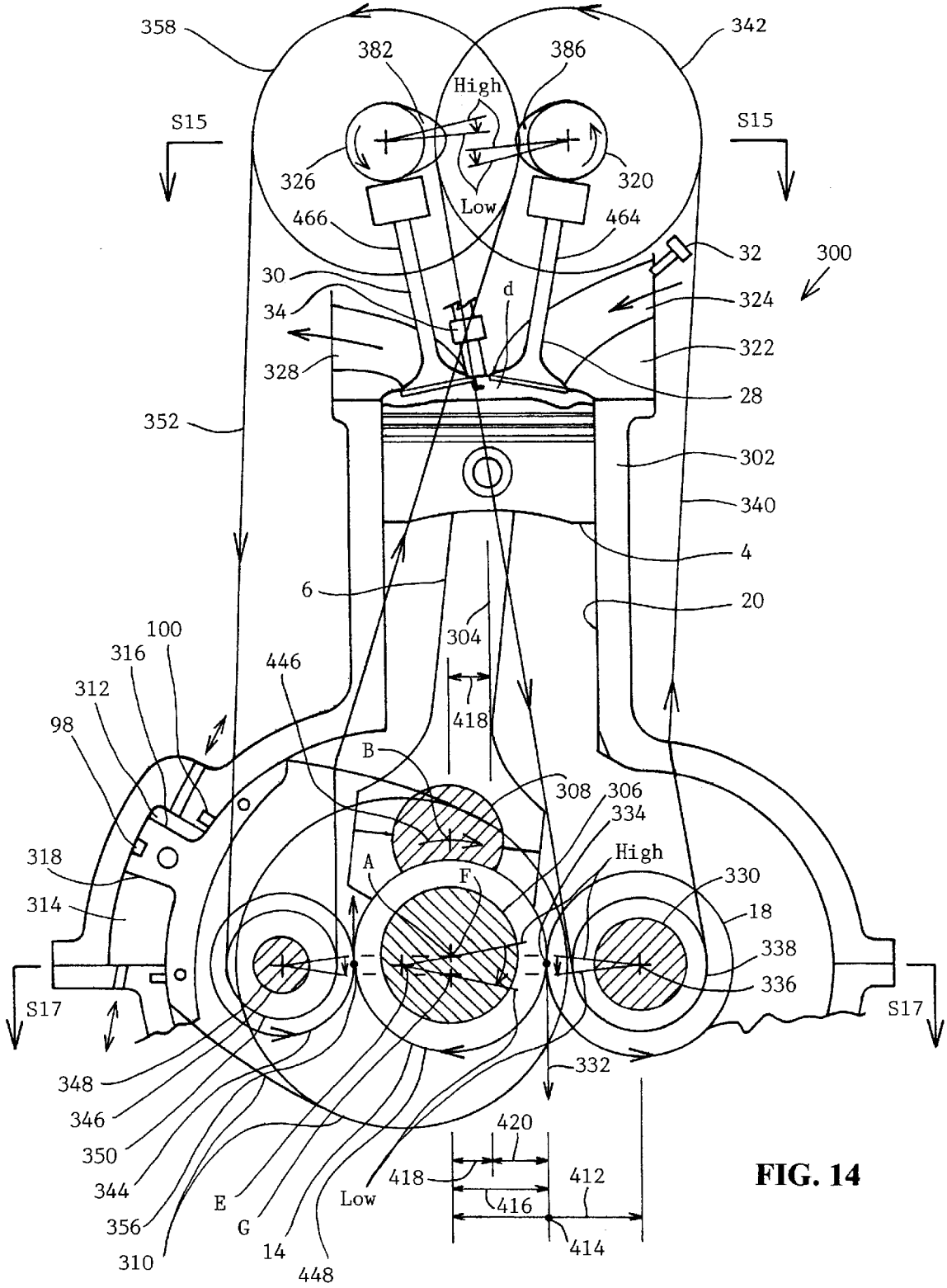
FIG. 14 shows a sectional view of an engine according to the present invention having an adjustable valve timing.

FIG. 14 shows the preferred embodiment of the present invention having adjustable valve timing. FIG. 14 shows an partial view of an engine 300 according to the present invention having a housing 302, a combustion chamber d, a cylinder bore 20, a cylinder centerline axis 304, a piston 4 mounted in cylinder 20 for reciprocating motion along cylinder centerline axis 304, a crankshaft 306 having an axis of rotation A and a crank pin 308, mounted in a ridged crankshaft cradle 310, and a connecting rod 6 connecting piston 4 and crank pin 308. Hydraulic fluid in chambers 312 and 314 acting on surfaces 316 and 318 respectively, rotate crankshaft cradle 310 about an axis E. Rotating crankshaft cradle 310 from a first position to a second position causes the crankshaft axis of rotation A to move from centerline axis F to centerline axis G, causing the volume of combustion chamber d to increase and the compression ratio of engine 300 to decrease. According to the present embodiment of the present invention, the crankshaft may be supported in housing 302 by crankshaft cradle 310 or other functional eccentric main bearing supports rotatably mounted in housing 302 about a eccentric pivot axis in housing 302. Engine 300 has one or more pistons 4, one or more intake camshafts 320, a cylinder head 322, one or more intake valves 28, one or more intake ports 324, one or more exhaust camshafts 326, one or more exhaust valves 30, and one or more exhaust ports 328. Intake valves 28 and exhaust valves 30 may be opened by direct attack inverted-bucket cam followers (shown) or by other functional means such as finger follower rocker arms (preferably of the roller follower type), centrally pivoted rockers, or another functional arrangement.

A drive gear 14 (gear teeth contact circle shown, and gear teeth not shown, for all gears and sprockets in FIG. 14) is mounted on crankshaft 306 and engages a driven gear 18 mounted on a secondary shaft 330. Drive gear 14 and driven gear 18 are in mesh and have a mesh direction 332 that points generally away from intake valve 28, and a gear mesh location 334. Gear mesh location 334 is located between eccentric pivot axis E and secondary shaft axis of rotation 336. The crankshaft axis of rotation A is located generally between eccentric pivot axis E and secondary shaft axis of rotation 336. Shaft 330 rotates on axis 336 in housing 302, and has a pulley, sprocket or other drive means 338 for driving belt or chain 340. Chain 340 rotates a pulley or sprocket or other drive means 342, and sprocket 342 turns intake camshaft 320. The camshaft drive including drive means 339, chain 340, and sprocket 342 may be substituted by an alternative functional camshaft drive. The secondary shaft 330 drives the camshaft drive, and the camshaft 320 opens intake valve 28. More specifically, clockwise rotation of crankshaft 306 rotates gear 14 clockwise, gear 14 then rotates gear 18, shaft 330 and sprocket 338 counterclockwise, sprocket 338 then drives chain 340 generally counterclockwise. Chain 340 then drives sprocket 342 and camshaft 320 counterclockwise, and camshaft 320 opens intake valve(s) 28.

Similarly, gear 14 mounted on crankshaft 306 engages a second driven gear 344 mounted on a third shaft 346. Shaft 346 rotates on axis 348, and has a pulley, sprocket or other drive means 350 for driving belt or chain 352. Drive gear 14 and driven gear 344 are in mesh and have a mesh direction 354 that points generally towards intake valve 28, and a gear mesh location 356. Gear mesh location 356 is located between eccentric pivot axis E and third shaft axis of rotation 348. Crankshaft axis of rotation A is located generally between mesh location 334 and mesh location 356. Mesh direction 354 is generally in an opposite direction to mesh direction 332. Chain 352 rotates a pulley or sprocket or other drive means 358, and sprocket 358 turns exhaust camshaft 326. The camshaft drive including drive means 350, chain 352, and sprocket 358 may be substituted by an alternative functional camshaft drive. Clockwise rotation of crankshaft 306 rotates gear 14 clockwise, gear 14 then rotates gear 344, shaft 346 and sprocket 350 counterclockwise, sprocket 350 then drives chain 352 generally counterclockwise. Chain 352 then drives sprocket 342 and camshaft 326 counterclockwise, and camshaft 326 opens exhaust valve(s) 30.

Figure 15:
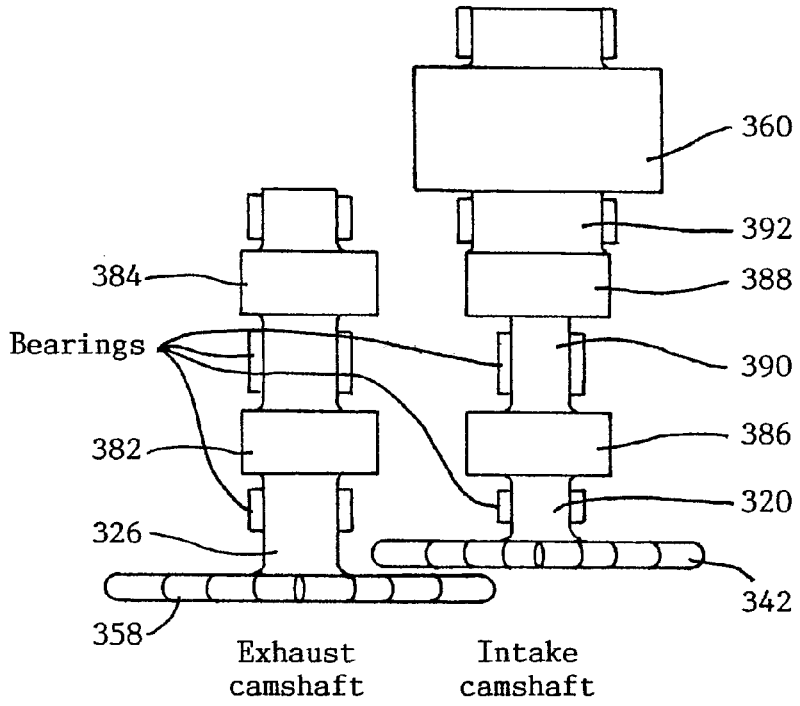
FIG. 15 shows a detailed view of the camshafts shown in FIG. 14.
Figure 15B:
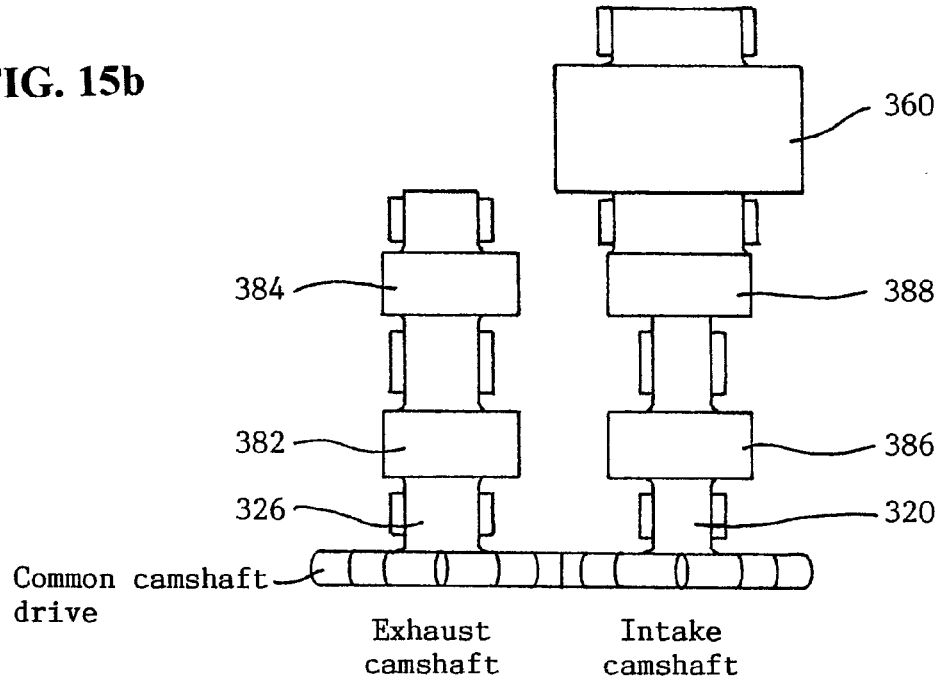
FIG. 15*b* shows an intake camshaft having a phase adjuster.

According to the present invention, exhaust valve 30 may be driven by shaft 330 and/or the intake camshaft drive, where the exhaust and intake cam shafts are phase shifted in the same direction when compression ratio is changed. in the embodiment shown in FIG. 15*b*, cylinder 20 (shown in FIG. 14) has two intake valves; intake camshaft 320 and exhaust camshaft 326 are driven by shaft 330 and the intake camshaft drive, and; intake camshaft 320 has a phase shifter 360 for adjusting the phase timing between the two intake valves, thereby providing a low friction valve train with adjustable valve control for providing low engine pumping losses. Alteratively, intake camshaft 320 and exhaust camshaft 326 may be driven by shaft 346 and the exhaust camshaft drive, where the exhaust and intake camshafts are phase shifted in the same direction when compression ratio is changed.

According to the present invention, the timing of exhaust valve closing (EVC) and the timing of intake valve opening (IVO) is adjusted to prevent valves 28 and 30 from striking piston 4 and improved idle stability (and in particular when crankshaft 306 is located on axis F and engine 300 is operating at its maximum compression ratio setting), and to provide improved flow of exhaust out of chamber d and into exhaust port 328, and improved flow of intake air through port 324 and into chamber d (and in particular when crankshaft 306 is located on axis G and engine 300 is operating at its minimum compression ratio setting). According to the present invention, the period of time that valves 28 and 30 are both open, the valve overlap period, is adjusted by rotating ridged crankshaft cradle 310 about axis E. Rotating ridged crankshaft cradle 310 about axis E from its first position (closest to intake valve 28) to its second position causes the axis of rotation of crankshaft 306 to move from axis location F to axis location G, and the phase relationship between gear 14 and gear 18 to adjust. Specifically, rotating ridged crankshaft cradle 310 about axis E from its first position to its second position causes gear 18 to rotate counterclockwise, and camshaft 320 to open valve 28 earlier relative to the timing of intake valve opening when crankshaft 306 is located on axis F. More specifically, intake valve 28 has a later timing of opening relative to crankshaft 306 at the first crankshaft position F than at the second crankshaft axis position G. Similarly, rotating ridged crankshaft cradle 310 about axis E from its first position to its second position causes the axis of rotation of crankshaft 306 to move from axis location F to axis location G, and the phase relationship between gear 14 and gear 344 to adjust. Specifically, rotating ridged crankshaft cradle 310 about axis E from its first position to its second position causes gear 344 to rotate clockwise, and camshaft 326 to close valve 30 later relative to the timing of exhaust valve closing when crankshaft 306 is located on axis F. Accordingly, the period of time that intake valve 28 and exhaust valve 30 are both open, the valve overlap period (VOL), is greater when crankshaft 306 is located on axis G than when crankshaft 306 is located on axis F.

The change in phase between gear 14 and gear 18 from the first crankshaft position to the second crankshaft position is, among other factors, a function of the distance between axis F and axis G, and the distance between axis A and axis 336. Similarly, the change in phase between gear 14 and gear 344 from the first crankshaft position to the second crankshaft position is, among other factors, a function of the distance between axis F and axis G, and the distance between axis A and axis 348. According to the present invention, the magnitude of phase change of gear 18 can be the same or different than the magnitude of phase change of gear 344. In the embodiment of the present invention shown in FIG. 14, the centerline distance between axis 348 and A is shorter than the centerline distance between axis 336 and A, and accordingly the magnitude of phase change is greater for gear 344 than gear 18 from the first crankshaft position to the second crankshaft position.

In the embodiment of the present invention shown in FIG. 14, the distance between gear 14 and 18 slightly changes as axis A moves from position F to position G. Similarly, the distance between gear 14 and 344 slightly changes as axis A moves from position F to position G. According to the present invention, engine 300 has power output means having a variable distance between gear 14 and gear 18, and gear 14 and gear 344, and according to the present invention moving the crankshaft centerline axis from a first position to a second position adjusts the phase of exhaust cam 326, the phase of intake cam 320, and/or the period of time that both intake and exhaust valves are open. Those skilled in the art will appreciate that the phase of exhaust cam 326, the phase of intake cam 320, and/or the period of time that both intake and exhaust valves are open may be adjusted according to the present invention with other power output coupling means such as shown in FIG. 4 of Deutsches Patentant DE 36 44721 A1, dated Dec. 30, 1986 and Jul. 14, 1988.

Those skilled in the art will appreciate that chain 340 and or 352 may be replaced with one or more gears that drive the cam lobes, and that the phase change of gear 18 and or 344 according to the present invention is unaffected.

Those skilled in the art will appreciate that according to the present invention both camshafts may be driven by a single chain or belt (e.g., 340 or 352) or gear set, with the phase change caused by moving the centerline axis of crankshaft 306 providing some benefit to at least one of the cam shafts. A phase adjuster may be employed to adjust the phase relationship between the two camshafts. A control system may be employed that prevents crankshaft 306 from being raised from position G to position F until after one or more phase shifters have adjusted the phase relation ship of one or both (or more) camshafts to prevent valves 28 and 30 from striking piston 4.

Figure 14B:
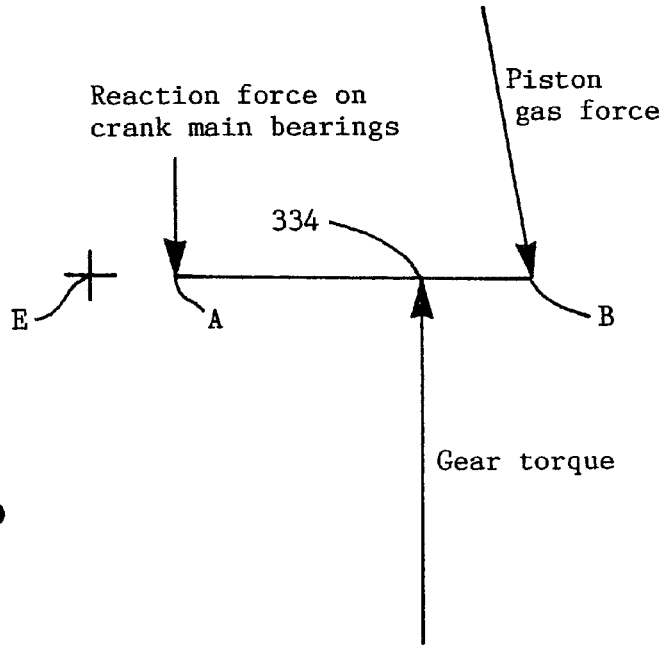
FIG. 14*b* shows a free-body diagram of forces acting on the crankshaft.
Figure 14C:
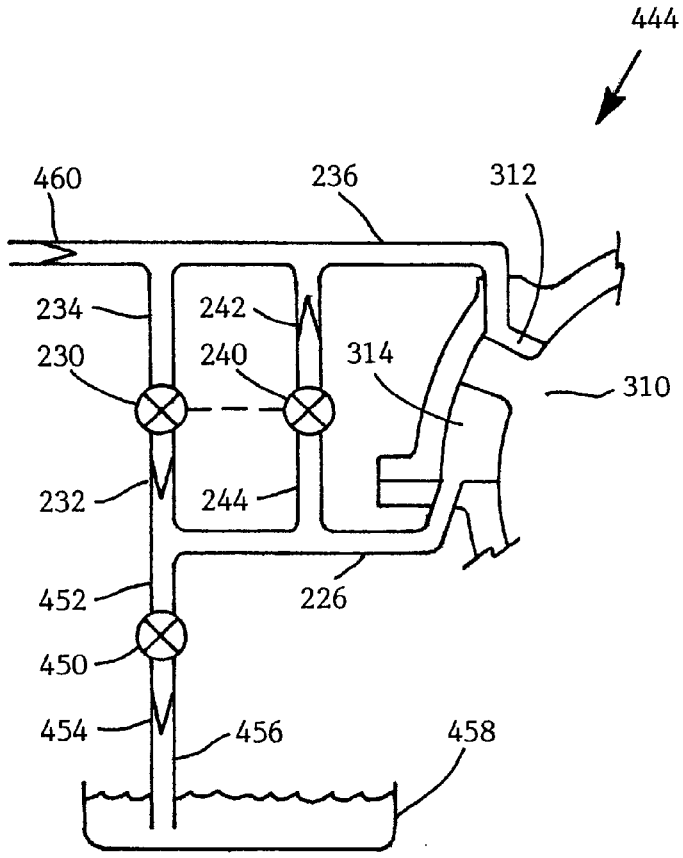
FIG. 14*c* shows a ratchet having hydraulic valves for movement of the crankshaft cradle in steps.
Figure 14D:
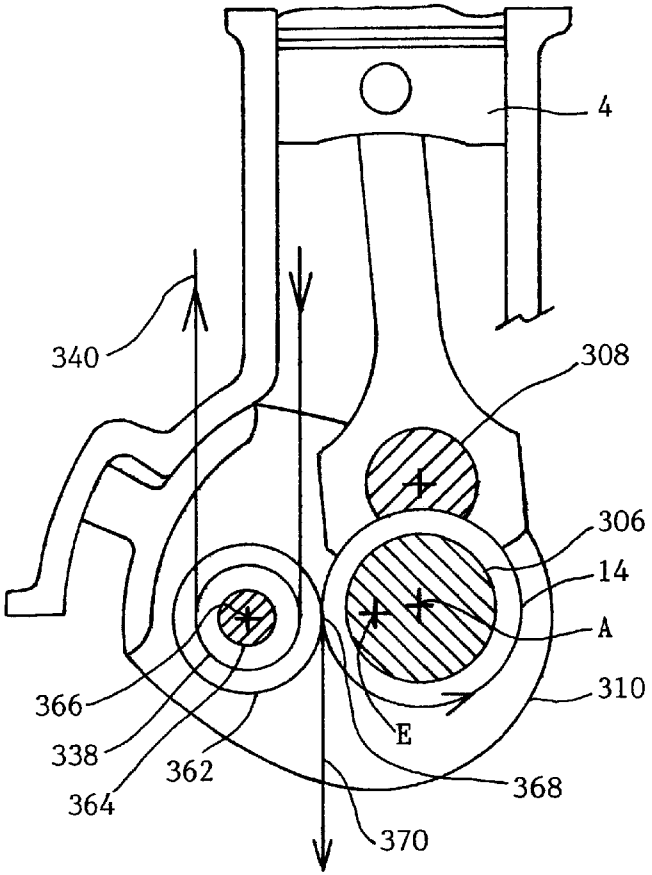
FIG. 14*d* shows a partial vie of an engine having a crankshaft rotating counterclockwise.

FIG. 14*d* shows diagramatically a portion of an engine according to the present invention similar to the engine shown in FIG. 14 except that the crankshaft 306 rotates counterclockwise about crankshaft rotational axis A, crankshaft 306 being mounted in crankshaft cradle 310 (partially shown) having a pivot axis E in the engine housing. Crankshaft 306 has a drive gear 14 in mesh with a driven gear 362 (gear teeth not shown) mounted on a shaft 364 having a rotational axis 366. Sprocket 338 is mounted on shaft 364 and drives chain or belt 340, and chain 340 drives an intake camshaft (not shown). Gears 14 and 362 are in mesh and have a mesh location 368 and a gear mesh direction 370 that points generally away from piston 4. Gear mesh location 368 is located between pivot axis E and rotational axis 362, and pivot axis E is located between crankshaft axis A and rotational axis 366, thereby providing optimal intake cam timing at high and low compression ratio settings.

Figure 14E:
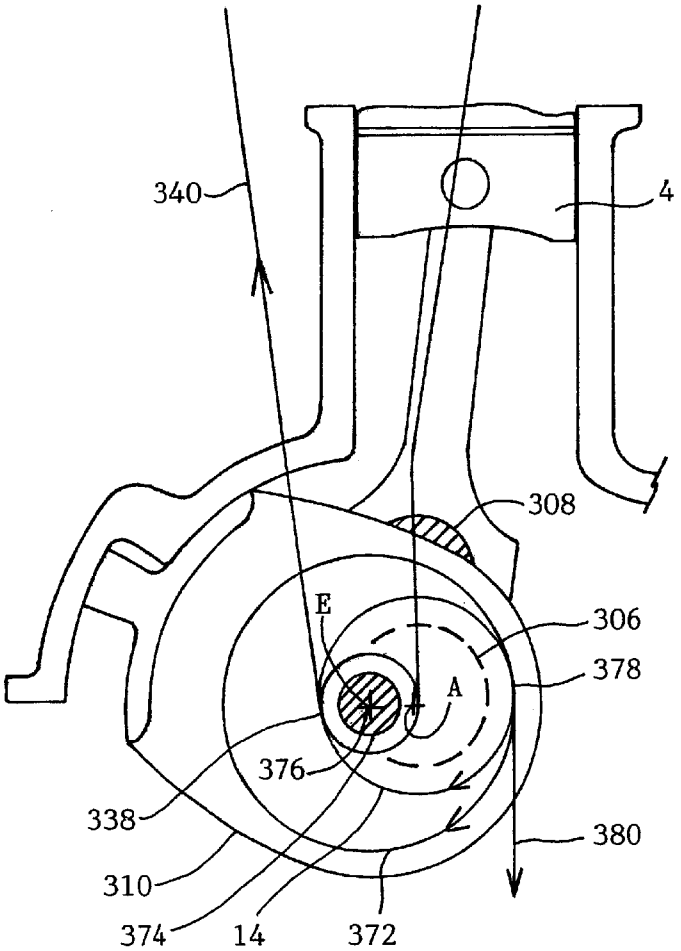
FIG. 14*e* shows an engine having an internal gear.

FIG. 14*e* shows diagramatically a portion of an engine according to the present invention similar to the engine shown in FIG. 14 except that crankshaft 306 has a drive gear 14 in mesh with an driven gear 372 (gear teeth not shown) mounted on a shaft 374 having a rotational axis 376. Drive gear 372 is an internal gear and rotates in the same direction as gear 14. Pivot axis E is preferably concentric with rotational axis 376. Sprocket 338 is mounted on shaft 374 and drives chain or belt 340, and chain 340 drives an intake camshaft (not shown). Gears 14 and 372 are in mesh and have a mesh location 378 and a gear mesh direction 380 that points generally away from piston 4, thereby providing optimal intake cam timing at high and low compression ratio settings.

FIG. 15 shows Exhaust camshaft 326 and intake camshaft 320 along cut lines S15—S15, shown in FIG. 14. Exhaust camshaft 326 has cam lobes 382 and 384. Those skilled in the art will appreciate that exhaust camshaft 326 can have one or more cam lobes. Intake camshaft 320 has cam lobes 386 and 388. Those skilled in the art will appreciate that intake camshaft 320 can have one or more cam lobes. In the embodiment of the present invention shown in FIG. 15, cam shaft 320 includes a primary drive shaft 390 and a follower 392, and an optional phase shifter 360 for changing the phase relationship between cam lobe 386 and 388.

Figure 17:
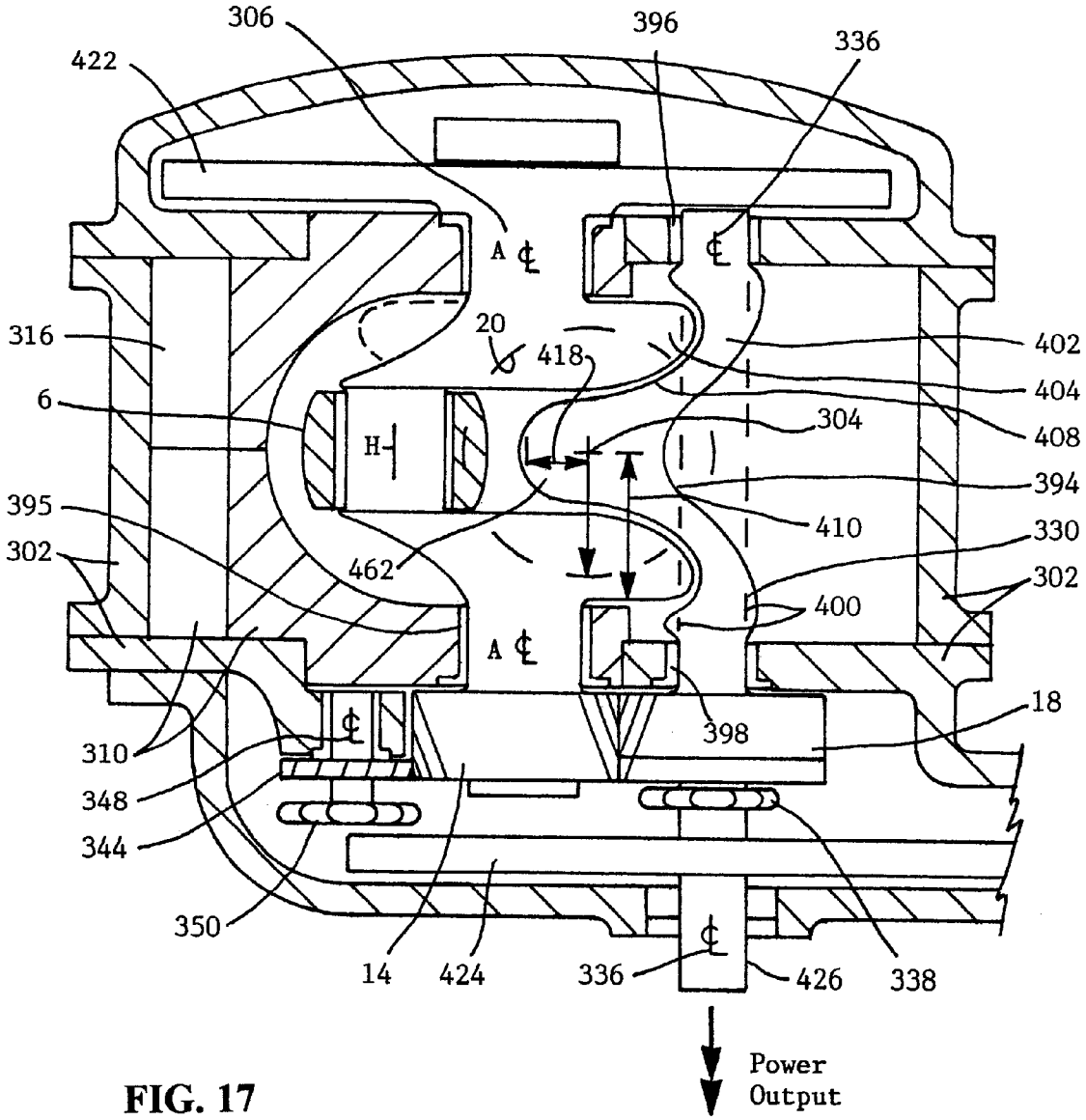
FIG. 17 shows a cross sectional view of a portion of the engine shown in FIG. 14.
Figure 17B:
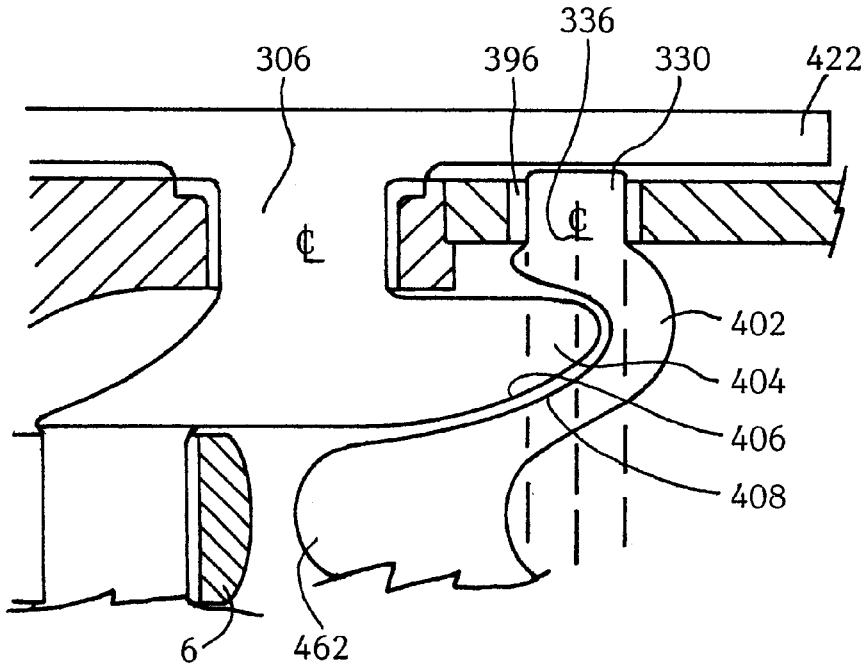
FIG. 17*b* shows a variation of a portion of the engine shown in FIG. 17.

FIG. 17 shows crankshaft 306, shaft 330, and ridged crankshaft cradle 310 along cut lines S17—S17 shown in FIG. 14. In the embodiment of the present invention shown in FIGS. 14 and 17, shaft 330 serves as a balance shaft. According to the present invention, engine 300 is balanced by minimizing the distance between crankshaft axis A and balance shaft axis 336, and by locating the cylinder centerline axis 304 between crankshaft axis A and balance shaft axis 336. Crankshaft 306 has a rotational speed and a rotational direction, and balance shaft 330 has a rotational speed and a rotational direction. Balance shaft 330 has the same rotational speed as crankshaft 306, and balance shaft 330 has an opposite rotational direction to crankshaft 306 for primary balancing. Balance shaft 330 has a bow 394 that bows inwardly across bearing diameter 400 and the centerline 336 of balance shaft 330, and that provides clearance for rod 6 during rotation of crankshaft 306 and balance shaft 330. Balance shaft 330 and crankshaft 306 rotate at the same speed but in opposite directions. Balance shaft 330 has bearings 396 and 398 each having an imaginary projected bearing diameter cylinder 400 running parallel to axis 336 (the bearing diameter cylinders of bearings 396 and 398 are dashed in as an imaginary lines 400 in FIG. 17). For engines having anti-friction bearings such as roller or ball bearings, the bearing diameter cylinder 400 is measured from the inner raceway. According to the present invention, rod 6 crosses at least one bearing diameter cylinder 400 and preferably rod 6 crosses balance shaft centerline axis 336 during rotation. Balance shaft 330 has bows 402 that bow in generally the opposite direction of bow 394, and provide clearance for counter weights 404. Preferably, bow 402 inwardly crosses at least one bearing diameter cylinder 400 to provide clearance for counterweights 404 bow 402 may inwardly cross balance shaft axis 336 (shown in FIG. 17*b*). Preferably, counterweights 404 cross at least one bearing diameter cylinder 400 during rotation of crankshaft 306, and counterweight 404 may cross balance shaft axis 336 (shown in FIG. 17*b*). Counter weights 404 have a radius 406 to closely pass clear of balance shaft 330, and balance shaft 330 has radiuses 408 to closely pass clear of counterweights 404. The outwardly force of counterweights 404 may be increased by adding a heavy metal to counterweights 404 such as tungsten or lead, or by increasing the length 410 of the crankshaft. In the embodiment of the present invention shown in FIG. 17, length 410 is greater than 90 percent of the radius r of bore 20, and preferably greater than the radius of bore 20, and bow 394 inwardly crosses balance shaft centerline 336. Distance 412 between crankshaft axis A and balance shaft axis 336 is shorter than the length of the stroke of piston 4, and preferably the distance between crankshaft axis A and balance shaft axis 336 is shorter than 90 percent of the length of the stroke of piston 4, thereby providing a reduced balance shaft spacing and improved engine balancing.

Referring now to FIGS. 14 and 17, crankshaft axis A and balance shaft axis 336 are separated by a distance 412 having a midpoint 414. Crankshaft axis of rotation A and midpoint 414 are separated by a distance 416, being half the length of distance 412. Cylinder centerline axis 304 and crankshaft axis A are separated by a distance 418. Cylinder centerline axis 304 and midpoint 414 are separated by a distance 420. Distances 412, 416, 418, and 420 change in length a very small amount with change in compression ratio. The change in length of distance 412, 416, 418, and 420 may be ignored with respect to engine balancing. Cylinder centerline axis 304 passes between crankshaft axis A and balance shaft axis 336. Engine 300 has a balance off-set ratio of distance 420 to distance 416 of no more than 0.90. In detail, the distance between the cylinder centerline axis 304 and midpoint 414 is at least 90 percent of the length between the crankshaft axis A and midpoint 414, thereby providing improved primary balance, and in particular providing improved primary balance in engines having only one balance shaft rotating at crankshaft rotational speed. Preferably, length 418 is greater than 20% of the distance between crankshaft axis A and balance shaft axis 336, and preferably length 418 is greater than 25% of the distance between crankshaft axis A and balance shaft axis 336. At a minimum, length 418 is greater than 15% of the distance between crankshaft axis A and balance shaft axis 336. Crank pin 308 has an axis B. The stroke of piston 4 is approximately equal to twice the distance from crank pin axis B to crankshaft axis A. Preferably, distance 418 between crankshaft axis A and cylinder centerline axis 304 is at least 10 percent as long as the length of the stroke of piston 4, thereby providing a reduced balance off-set and improved engine balancing. According to the present invention, the power stroke of engine 300 drives the big end of rod 6 down between the crankshaft axis A and the balance shaft axis 336, and more specifically, the mesh direction 332 between gear 14 and gear 18 points generally away from piston 4, thereby providing reduced friction in addition to improved balance. The present invention significantly improved engine balancing, and in particular for engines having fewer than three pistons where primary balancing is poor.

Counterweight 422 is mounted on crankshaft 306, and counterweight 424 is mounted on shaft 330. Preferably the polar moment of inertia of 422 is the same or almost the same as the polar moment of inertia of 424. Counterweight 422 is mounted on the front end of engine 300 and crosses axis 336, and counterweight 424 is mounted on the back end of engine 300 and crosses axis A. Counterweight 424 is located on the same end of shaft 330 as gear 18 and the power output of engine 300 is through the same end of shaft 330, and power may be taken out through shaft end 426, through gear 18, or through other suitable means. Crankshaft 306 is sufficiently ridged to prevent unacceptable levels of vibration, and in particular harmonic vibration between flywheel 422 and flywheel 424. Those skilled in the art will appreciate that engine 300 may have other arrangements according to the present invention.

Figure 18:
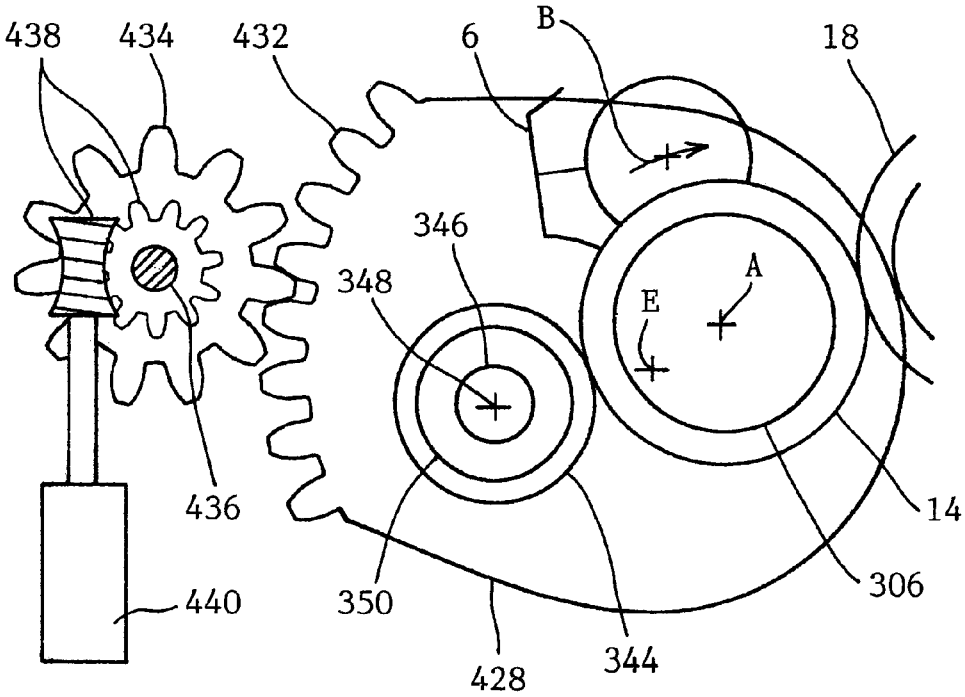
FIG. 18 shows a ridged crankshaft cradle having an actuator motor.

FIG. 18 shows a ridged crankshaft cradle 428 that that is similar to the ridged crankshaft cradle 310 shown in FIG. 14, except that ridged crankshaft cradle 428 is electrically or hydraulically actuated through an electric or hydraulic motor 440. Ridged crankshaft cradle 428 has gear teeth 432, that engage a drive gear 434. Drive gear 434 is mounted on a shaft 436 having a worm gear drive 438. Worm gear 438 is driven by motor 440. Motor 440 may be electric or hydraulic. According to the present invention, motor 440 turns worm gear 438, which turns shaft 436 and gear 434, which rotates ridged crankshaft cradle 428 about axis E and adjusts the position of crankshaft centerline axis A. Backlash between gear 434 and 432, and/or between other gears may be prevented or minimized by one or more anti-backlash gears (for example an anti-backlash gear may be mounted on the face of gear 434) or a pre-load spring such as a pre-load coil spring mounted concentricaly on shaft 442 (not shown). Those skilled in the art will appreciate that other arrangements of gears may be used to transfer rotational torque from motor 440 to ridged crankshaft cradle 428.

Referring now to FIGS. 14, 14*b*, and 14*c*, crankshaft 306 is moved by crankshaft cradle 310, or another type of eccentric main bearing supports, towards cylinder head 322 of engine 300 during a portion of the power stroke of piston 4. FIG. 14*b* shows a free-body diagram of forces acting on crankshaft 306 located at 90 crank angle degrees clockwise from top dead center as shown in FIG. 14. In more detail, FIG. 14*b* shows piston gas force acting through crank pin axis B (located at 90 crank angle degrees clockwise after top dead), gear torque acting on crankshaft 306 at gear mesh location 334, and a reaction force acting on crankshaft cradle 310 at crankshaft rotational axis A. FIG. 14*c* shows a detailed view of a ratchet 444. Ratchet 444 attaches to engine 300 shown in FIG. 14.

Referring now to FIGS. 14 and 14*b*, according to the present invention, crankshaft 306 serves as a lever, and gear mesh 334 serves as a fulcrum. Crank pin 308 is located at a first end of the "lever" (e.g., crankshaft), and the crankshaft main bearings 395 located about crankshaft axis A (shown in FIG. 17) are located at the other end of the "lever", with gear mesh 334 located between the first and second ends of the "lever" and serving as a fulcrum. The force of the power stroke (at approximately 90 crank angle degrees after top dead center) bearing down on the crank pin (the first end of the lever) causes an upward force on crankshaft cradle 310 by crankshaft main bearings 395 (e.g., located at the second end of the lever), where gear mesh 334 acts as a fulcrum. A ratchet 444 permits crankshaft cradle 310 to rotate (counterclockwise as shown in FIG. 14) causing the centerline of crankshaft 306 to move towards cylinder head 322. Ratchet 444 prevents crankshaft cradle 310 from rotating in the opposite direction, thereby causing crankshaft 306 to advance towards cylinder head 322 in steps.

In detail, crank pin centerline B has an orbital diameter 446, and drive gear 14 has a pitch diameter 448. Crankshaft 306 is moved towards cylinder head 322 during a portion of the power stroke of piston 4 by placing the orbital diameter 446 of crank pin 308 outside of the pitch diameter 448 of the drive gear 14; placing drive gear 14 in mesh with driven gear 18; placing crank pin 308 during the power stroke of piston 4 on the opposite side of gear mesh location 334 from crankshaft axis A and crankshaft main bearings 395; firing the engine; and ratcheting crankshaft cradle 310 and crankshaft 306 towards cylinder head 322 in steps, where the crankshaft main bearings 395 and the crankshaft 306 pivot toward the cylinder head about gear mesh 334 under the force away from the cylinder head 322 of the power stroke acting on crank pin 308.

According to the present invention, the force of the piston on crank pin 308 during a portion of the power stroke may not be sufficient to cause the crankshaft to move towards cylinder head 322, or move the crankshaft to cylinder head 322 quickly enough. According to the present invention, oil pressure in chamber 312 may be sufficiently increased to cause crankshaft cradle 310 to rotate and crankshaft 306 to move towards cylinder head 322 under the combined force of the oil pressure in chamber 312 and the force of the piston on crank pin 308 during a portion of the power stroke.

FIG. 14*c* shows ratchet 444. According to the present invention, crankshaft cradle 310 may be moved in steps by a hydraulic ratchet (shown in FIG. 4*c*), a mechanical ratchet, an electrical ratchet, a hydro-mechanical, electric ratchet, or another type of functional ratchet. FIG. 14*c* shows a hydraulic ratchet that is similar to the hydraulic system shown in FIG. 9, except that the outflow from chamber 314 is ducted into the inflow of chamber 312, and the outflow of chamber 312 is ducted into the inflow of chamber 314 thereby reducing actuator power and preventing hydraulic cavitation.

Referring to FIG. 14*c*, crankshaft cradle 310 is moved clockwise for moving crankshaft 306 away from cylinder head 322 by closing valves 240 and 450 and opening valve 230. Clockwise motion of crankshaft cradle 310 caused be forces on crankshaft 306 causes fluid to be forced out of chamber 312 into duct 236 into duct 234, through open valve 230, through one-way valve 232 through duct 226, and into chamber 314. Reverse flow is prevented by one-way or check valve 232.

Crankshaft cradle 310 is moved counterclockwise for moving crankshaft 306 towards cylinder head 322 by opening valve 240 and closing valve 230. Counterclockwise motion of crankshaft cradle 310 caused be forces on crankshaft 306 causes fluid to be forced out of chamber 314 into duct 226, into duct 244, through open valve 240, through one-way valve 242 through duct 236, and into chamber 312. Reverse flow is prevented by one-way or check valve 242. Counterclockwise motion of crankshaft cradle 310 and movement of crankshaft 306 towards cylinder head may be assisted by opening valve 450. Opening valve 450 permits feed oil under pressure to enter chamber 312 through valve 460 and duct 236, causing crankshaft cradle 310 to rotate counterclockwise and fluid in chamber 314 to be forced through duct 226, though duct 452, through valve 450, through one way valve 454, and through drain pipe 456 into an oil pan 458 or into another functional drainage receptacle. Drain pipe 456 opens into oil pan 458 below the surface of the oil in the pan in order to prevent air from entering oil feed lines 456, 452, 226 and ultimately chambers 314 and 312. Valves 230 and 240 may be located on the same spool and opened together. In systems were actuator 444 is operated with valve 450 closed, the volume displaced from chamber 314 must be the same as the volume added to chamber 312 for a given amount of rotation of crankshaft cradle 310. Piston type chambers, or another functional type of hydraulic chambers, may be used as an alternative to chambers 312 and 314.

What is claimed is:

1. A variable compression ratio engine with an adjustable valve timing having an engine housing and a crankshaft having a crankshaft axis of rotation, a first crankshaft axis position relative to said housing, and a second crankshaft axis position relative to said housing, and one or more eccentric main bearing supports, rotatably mounted in said housing about an eccentric pivot axis in said housing, for adjusting said crankshaft axis from said first crankshaft axis position to said second crankshaft axis position, a drive gear mounted on said crankshaft, and a driven gear mounted on a secondary shaft having a second shaft axis of rotation, said second shaft axis of rotation being fixed in said housing, said drive gear being in mesh with said driven gear, said drive gear and said driven gear having a first mesh direction and a first mesh location, a first intake valve and a camshaft having a camshaft drive, said secondary shaft drives said camshaft drive, and said camshaft opens said intake valve, wherein said first mesh direction points generally away from said first intake valve, said first crankshaft axis position being closer to said first valve than said second crankshaft axis position, said camshaft has a first phase timing relative to said crankshaft at said first crankshaft axis position, and said camshaft has a second phase timing relative to said crankshaft at said second crankshaft axis position, wherein said intake valve has a later timing of opening relative to said crankshaft at said first crankshaft axis position than at said second crankshaft axis position, wherein said first mesh location is located between said eccentric pivot axis and said second shaft axis of rotation.

2. The variable compression ratio engine with an adjustable valve timing of claim 1, wherein said crankshaft axis of rotation is located generally between said eccentric pivot axis and said second shaft axis of rotation.

3. A variable compression ratio engine with an adjustable valve timing having an engine housing, a crankshaft having a crankshaft axis of rotation, a first exhaust valve and an exhaust valve drive, a first crankshaft axis position relative to said housing, and a second crankshaft axis position relative to said housing, and one or more eccentric main bearing supports, rotatably mounted in said housing about an eccentric pivot axis in said housing, for adjusting said crankshaft axis from said first crankshaft axis position to said second crankshaft axis position, a drive gear mounted on said crankshaft, and a driven gear mounted on a secondary shaft having a second shaft axis of rotation, said second shaft axis of rotation being fixed in said housing, said drive gear being in mesh with said driven gear, said drive gear and said driven gear having a first mesh direction and a first mesh location, a first intake valve and a camshaft having a camshaft drive, said secondary shaft drives said camshaft drive, and said camshaft opens said intake valve, wherein said first mesh direction points generally away from said first intake valve, said first crankshaft axis position being closer to said first valve than said second crankshaft axis position, said camshaft has a first phase timing relative to said crankshaft at said first crankshaft axis position, and said camshaft has a second phase timing relative to said crankshaft at said second crankshaft axis position, wherein said intake valve has a later timing of opening relative to said crankshaft at said first crankshaft axis position than at said second crankshaft axis position, wherein said first exhaust valve and said first intake valve have a first valve overlap period at said first crankshaft axis position and a second valve overlap period at said second crankshaft axis position, said first valve overlap period being shorter than said second valve overlap period.

4. The variable compression ratio engine with an adjustable valve timing of claim 3, further having a second driven gear mounted on a third shaft having a third axis of rotation, said third axis of rotation being fixed in said housing, said second driven gear being in mesh with a gear mounted on said crankshaft and having a second mesh direction and a second mesh location, said crankshaft axis of rotation being located generally between said first mesh location and said second mesh location, and said second mesh direction being generally opposite to said first mesh direction.

5. A variable compression ratio engine with an adjustable valve timing having an engine housing, a crankshaft having a crankshaft axis of rotation, and a first exhaust valve, a first crankshaft axis position relative to said housing, and a second crankshaft axis position relative to said housing, and one or more eccentric main bearing supports, rotatably mounted in said housing about an eccentric pivot axis in said housing, for adjusting said crankshaft axis from said first crankshaft axis position to said second crankshaft axis position, a drive gear mounted on said crankshaft, and a driven gear mounted on a secondary shaft having a second shaft axis of rotation, said second shaft axis of rotation being fixed in said housing, said drive gear being in mesh with said driven gear, said drive gear and said driven gear having a first mesh direction and a first mesh location, a first intake valve and a camshaft having a camshaft drive, said secondary shaft drives said camshaft drive, and said camshaft opens said intake valve, wherein said first mesh direction points generally away from said first intake valve, said first crankshaft axis position being closer to said first valve than said second crankshaft axis position, said camshaft has a first phase timing relative to said crankshaft at said first crankshaft axis position, and said camshaft has a second phase timing relative to said crankshaft at said second crankshaft axis position, wherein said intake valve has a later timing of opening relative to said crankshaft at said first crankshaft axis position than at said second crankshaft axis position, and said exhaust valve is driven by said driven gear mounted on said secondary shaft.

6. The variable compression ratio engine with an adjustable valve timing of claim 5, further having a second intake valve and a intake valve timing phase shifter for adjusting the timing of said second intake valve relative to said first intake valve.

7. An internal combustion engine having a crankshaft, said crankshaft having a crankshaft axis of rotation, a crankshaft rotational speed and a crankshaft rotational direction, a piston, and a connecting rod connecting said piston and said crankshaft, a cylinder having a cylinder centerline axis, said piston being mounted in said cylinder for reciprocating motion along said cylinder centerline axis, a balance shaft having a balance shaft axis of rotation, a balance shaft rotational speed and a balance shaft rotational direction, said balance shaft rotational direction and said crankshaft rotational direction being opposite, said balance shaft rotational speed and said crankshaft rotational speed being the same, a first distance from said crankshaft axis of rotation to said balance shaft axis of rotation having a mid point, a second distance from said crankshaft axis of rotation to said mid point, said second distance being equal in length to half of said first distance, and a third distance from said cylinder centerline axis to said mid point, wherein said engine has only one of said balance shafts rotating at said crankshaft rotational speed, wherein said cylinder centerline axis passes between said crankshaft axis of rotation and said balance shaft axis of rotation, wherein said engine has a balance off-set ratio of said third distance to said second distance of no more than 0.90, thereby providing an improved primary balance.

8. An internal combustion engine having a crankshaft, said crankshaft having a crankshaft axis of rotation, a crankshaft rotational speed and a crankshaft rotational direction, a piston, and a connecting rod connecting said piston and said crankshaft, a cylinder having a cylinder centerline axis, said piston being mounted in said cylinder for reciprocating motion along said cylinder centerline axis, a balance shaft having a balance shaft axis of rotation, a balance shaft rotational speed and a balance shaft rotational direction, said balance shaft rotational direction and said crankshaft rotational direction being opposite, said balance shaft rotational speed and said crankshaft rotational speed being the same, a first distance from said crankshaft axis of rotation to said balance shaft axis of rotation having a mid point, a second distance from said crankshaft axis of rotation to said mid point, said second distance being equal in length to half of said first distance, and a third distance from said cylinder centerline axis to said mid point, wherein said cylinder centerline axis passes between said crankshaft axis of rotation and said balance shaft axis of rotation, wherein said engine has a balance off-set ratio of said third distance to said second distance of no more than 0.90, wherein said cylinder centerline axis and said crankshaft axis of rotation are separated by a fourth distance, said fourth distance being at least 15 percent as long as said first distance, thereby providing an improved primary balance.

9. An internal combustion engine having a crankshaft, said crankshaft having a crankshaft axis of rotation, a crankshaft rotational speed and a crankshaft rotational direction, a piston, and a connecting rod connecting said piston and said crankshaft, a cylinder having a cylinder centerline axis, said piston being mounted in said cylinder for reciprocating motion along said cylinder centerline axis, a balance shaft having a balance shaft axis of rotation, a balance shaft rotational speed and a balance shaft rotational direction, said balance shaft rotational direction and said crankshaft rotational direction being opposite, said balance shaft rotational speed and said crankshaft rotational speed being the same, a first distance from said crankshaft axis of rotation to said balance shaft axis of rotation having a mid point, a second distance from said crankshaft axis of rotation to said mid point, said second distance being equal in length to half of said first distance, and a third distance from said cylinder centerline axis to said mid point, said cylinder centerline axis and said crankshaft axis of rotation are separated by a fourth distance, wherein said cylinder centerline axis passes between said crankshaft axis of rotation and said balance shaft axis of rotation, wherein said engine has a balance off-set ratio of said third distance to said second distance of no more than 0.90, wherein said piston has a stroke having a length, said fourth distance being at least 10 percent as long as said stroke, thereby providing an improved primary balance.

10. An internal combustion engine having a crankshaft, said crankshaft having a crankshaft axis of rotation, a crankshaft rotational speed and a crankshaft rotational direction, a piston, and a connecting rod connecting said piston and said crankshaft, a cylinder having a cylinder centerline axis, said piston being mounted in said cylinder for reciprocating motion along said cylinder centerline axis, and said piston has a stroke having a length, a balance shaft having a balance shaft axis of rotation, a balance shaft rotational speed and a balance shaft rotational direction, said balance shaft rotational direction and said crankshaft rotational direction being opposite, said balance shaft rotational speed and said crankshaft rotational speed being the same, a first distance from said crankshaft axis of rotation to said balance shaft axis of rotation having a mid point, a second distance from said crankshaft axis of rotation to said mid point, said second distance being equal in length to half of said first distance, and a third distance from said cylinder centerline axis to said mid point, wherein said cylinder centerline axis passes between said crankshaft axis of rotation and said balance shaft axis of rotation, wherein said engine has a balance off-set ratio of said third distance to said second distance of no more than 0.90, and said first distance is less than the length of said stroke, thereby providing an improved primary balance.

11. A variable compression ratio internal combustion engine having a crankshaft, said crankshaft having a crankshaft axis of rotation, a crankshaft rotational speed and a crankshaft rotational direction, a piston, and a connecting rod connecting said piston and said crankshaft, a cylinder having a cylinder centerline axis, said piston being mounted in said cylinder for reciprocating motion along said cylinder centerline axis, a balance shaft having a balance shaft axis of rotation, a balance shaft rotational speed and a balance shaft rotational direction, said balance shaft rotational direction and said crankshaft rotational direction being opposite, said balance shaft rotational speed and said crankshaft rotational speed being the same, a first distance from said crankshaft axis of rotation to said balance shaft axis of rotation having a mid point, a second distance from said crankshaft axis of rotation to said mid point, said second distance being equal in length to half of said first distance, and a third distance from said cylinder centerline axis to said mid point, wherein said cylinder centerline axis passes between said crankshaft axis of rotation and said balance shaft axis of rotation, wherein said engine has a balance off-set ratio of said third distance to said second distance of no more than 0.90, thereby providing an improved primary balance, wherein said engine has a drive gear mounted on said crankshaft and a driven gear mounted on said balance shaft, said drive gear being in mesh with said driven gear, said drive gear and said driven gear having a mesh direction, wherein said mesh direction points generally away from said piston, thereby providing improved balance and reduced friction.

12. A method for moving a crankshaft of an engine about a pivot axis towards the cylinder head of the engine during a portion of the power stroke of a first piston for adjusting the compression ratio of the engine, wherein the engine has a crankshaft having a crankshaft axis of rotation, crankshaft main bearings, and a crank pin having an orbital diameter, a connecting rod for connecting said first piston and said crank pin, an engine housing and one or more eccentric main bearing supports rotatably mounted in said housing about a pivot axis in said housing for pivotally supporting said crankshaft in said crankshaft main bearings, a drive gear mounted on said crankshaft for transferring power from said crankshaft to a power take-off shaft, said drive gear having a pitch diameter, and a driven gear mounted on said power take-off shaft, and, a first ratchet for ratcheting said eccentric main bearing supports in a first pivot direction, said first ratchet being disengagable for rotation of said eccentric main bearing supports in a second pivot direction, comprising the steps of;

placing the orbital diameter of the crank pin outside of the pitch diameter of the drive gear;

placing the drive gear in mesh with the driven gear;

placing the crank pin during the power stroke of the first piston on the opposite side of the gear mesh from the crankshaft main bearings;

firing the engine; and ratcheting the crankshaft towards the cylinder head in steps, wherein the crankshaft main bearings pivot toward the cylinder head about the gear mesh under the force away from the cylinder head of the power stroke acting on the crank pin, and the crankshaft is ratcheted towards the cylinder head in steps.

* * * * *